US010011138B2

(12) United States Patent
Sakata

(10) Patent No.: US 10,011,138 B2
(45) Date of Patent: Jul. 3, 2018

(54) SHEET PROCESSING APPARATUS, METHOD OF CONTROLLING THE SAME AND COMPUTER-READABLE STORAGE MEDIUM

(71) Applicant: CANON KABUSHIKI KAISHA, Tokyo (JP)

(72) Inventor: Munetaka Sakata, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/635,256

(22) Filed: Mar. 2, 2015

(65) Prior Publication Data

US 2015/0251476 A1 Sep. 10, 2015

(30) Foreign Application Priority Data

Mar. 10, 2014 (JP) ..... 2014-046756

(51) Int. Cl.

| | |
|---|---|
| ***B42C 9/00*** | (2006.01) |
| ***B42C 13/00*** | (2006.01) |
| ***B42C 7/00*** | (2006.01) |
| ***G03G 15/00*** | (2006.01) |

(52) U.S. Cl.

CPC ..... *B42C 7/005* (2013.01); *G03G 15/6544* (2013.01); *G03G 2215/00877* (2013.01); *G03G 2215/00936* (2013.01)

(58) Field of Classification Search

CPC ..... B42C 9/00; B42C 13/00; B42C 7/00

USPC ..... 412/9, 11, 14, 17, 22

See application file for complete search history.

(56) References Cited

U.S. PATENT DOCUMENTS

2012/0308334 A1* 12/2012 Nonoshita ..... B42C 7/005 412/11

2014/0255127 A1* 9/2014 Yamaguchi ..... B31D 1/00 412/33

FOREIGN PATENT DOCUMENTS

| | | |
|---|---|---|
| JP | 2007-118351 A | 5/2007 |
| JP | 2013-119451 A | 6/2013 |
| WO | 2011/096041 A1 | 8/2011 |

OTHER PUBLICATIONS

Muneta Sakata, U.S. Appl. No. 14/614,438, filed Feb. 5, 2015.

Office Action dated Feb. 9, 2018, in Japanese Patent Application No. 2014-046756.

* cited by examiner

*Primary Examiner* — Justin V Lewis

(74) *Attorney, Agent, or Firm* — Fitzpatrick, Cella, Harper & Scinto

(57) ABSTRACT

A sheet processing apparatus operable to perform creasing processing on media, and a method of controlling the same, accept an offset position of a crease for folding of a cover of a bookbinding product which is a length from an edge of a spine of the bookbinding product, and acquire a position of the crease for folding corresponding to the cover using at least a size of the cover, the offset position, and a thickness of the bookbinding product. Based on the acquired position of the crease, creasing processing is executed on the cover.

9 Claims, 21 Drawing Sheets

LEFT STITCH SADDLE STITCH BINDING

RIGHT STITCH SADDLE STITCH BINDING

SHEET PROCESSING APPARATUS, METHOD OF CONTROLLING THE SAME AND COMPUTER-READABLE STORAGE MEDIUM

BACKGROUND OF THE INVENTION

Field of the Invention

The present invention relates to a sheet processing apparatus, a method of controlling the same, and a computer-readable storage medium.

Description of the Related Art

In recent years, creasing processing is increasingly being applied to a printed material on which bookbinding such as case binding is performed using an image forming apparatus such as a digital copying machine or a multi-function peripheral. Creasing is processing for adding a crease to a printing sheet (hereinafter referred to as media) prior to folding processing being applied. For example, in the case of case binding, there are cases in which a creasing is applied to the edge of the spine of the case binding. By doing this, the fold on the edge of the spine becomes more attractive, and the quality of the resulting document (bookbinding product) that is bound can be raised.

Also, creasing is used to add a crease to a position at which a user wishes to insert a fold. For example, often media having a large paper thickness is used for a cover when case binding. So, there is an advantage of making it easier for the user to open the cover by adding a crease to the cover in advance. Furthermore, because a cover and inner sheets are glued in case binding, it is easy for the cover to be peeled off if too much force is applied to a position that is glued when the cover is opened. So, by adding a crease at a location away from the position that is glued, a load is not put onto the glued position even when the user opens the cover, and there is the advantage that this can prevent the cover being easily peeled off. Hereinafter, a crease applied to a position at which a user wishes to insert a fold, as described above, is described as a crease for folding.

For a crease for folding, the position should be determined considering the convenience of the user. For example, if the edge of the spine of the case binding and the position of the crease for folding are too close, it will be difficult for the user to open the cover when holding the case bound book in his or her hand. Also, if the edge of the spine of the case binding and the position of the crease for folding are too separated, the contents of the first page of the book will be overlapped by the position of the crease for folding, and so the contents of the page will be difficult to see. In other words, the position of the crease for folding should be determined for each case binding, and the crease for folding is not something that can be applied at a fixed position.

Also, normally, an edge of the media is made to be a basis position, and it is necessary to designate the creasing position to be at a position that is separated from the basis position by a predetermined length. This is because the creaser apparatus is configured so as to detect a leading edge of a sheet, and to apply the creasing processing to a position that is an instructed length from the leading edge position.

An approach to designating the position of the crease for folding is described in Japanese Patent Laid-Open No. 2013-119451, for example. Using this approach, it is possible to apply creases for folding to a cover of a case binding, where the number of creases and the positions of the creases are designated by an operator.

In the approach described in the foregoing Japanese Patent Laid-Open No. 2013-119451, it is possible to apply the creases for folding in accordance with positions that the operator designated and a number that the operator designated, but it is necessary for the operator himself to determine the positions of the folding creases having understood the length of the media. However, normally, it is often the case that the position of the crease for folding is considered under the basis of the length from the edge of the spine cover. For this reason, when the approach of Japanese Patent Laid-Open No. 2013-119451 is used, the operator must determine the position of the crease for folding by calculation having understood the length of the media, and this is cumbersome.

SUMMARY OF THE INVENTION

The present invention provides a technique in which the creasing position for folding in a bookbinding product can be designated easily.

A sheet processing apparatus according to one embodiment of the present invention for achieving the above described object has the following configuration. Specifically, a sheet processing apparatus operable to perform creasing processing on media comprises: an accepting unit configured to accept an offset position of a crease for folding of a cover of a bookbinding product which is a length from an edge of a spine of the bookbinding product; an acquisition unit configured to acquire a position of the crease for folding corresponding to the cover using at least a size of the cover, the offset position, and a thickness of the bookbinding product; and a crease processing unit configured to, based on the position of the crease acquired by the acquisition unit, execute creasing processing on the cover.

By virtue of the present invention, there is the effect that it is possible to designate a creasing position for folding in a bookbinding product easily.

Further features of the present invention will become apparent from the following description of exemplary embodiments (with reference to the attached drawings).

Note, in the accompanying drawings, the same reference numerals are added for same or similar configuration elements.

BRIEF DESCRIPTION OF THE DRAWINGS

The accompanying drawings, which are incorporated in and constitute a part of the specification, illustrate embodiments of the invention and, together with the description, serve to explain the principles of the invention.

DESCRIPTION OF THE EMBODIMENTS

Embodiments of the present invention will be described hereinafter in detail, with reference to the accompanying drawings. It is to be understood that the following embodiments are not intended to limit the scope of the claims of the present invention, and that not all of the combinations of the aspects that are described according to the following embodiments are necessarily required with respect to the means to solve the problems according to the present invention.

Figure 1:
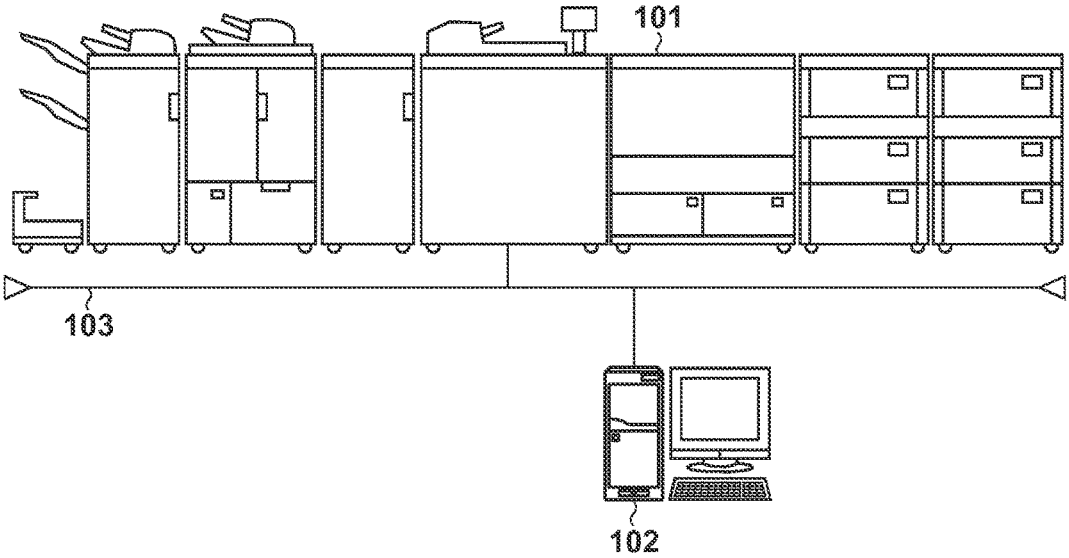
FIG. 1 is a view for showing a configuration of a sheet processing system.

FIG. 1 is a view for showing a configuration of a sheet processing system according to embodiments.

The sheet processing system comprises an image forming apparatus 101, an image processing apparatus 102, and a network 103 which connects these. The image processing apparatus 102 is used to perform processing such as generation of a print job by an operator operation, and the image processing apparatus 102 performs processing such as job management, RIP (raster image processing), and imposition, and causes processed image data to be printed by transmitting the data to the image forming apparatus 101.

Figure 2:
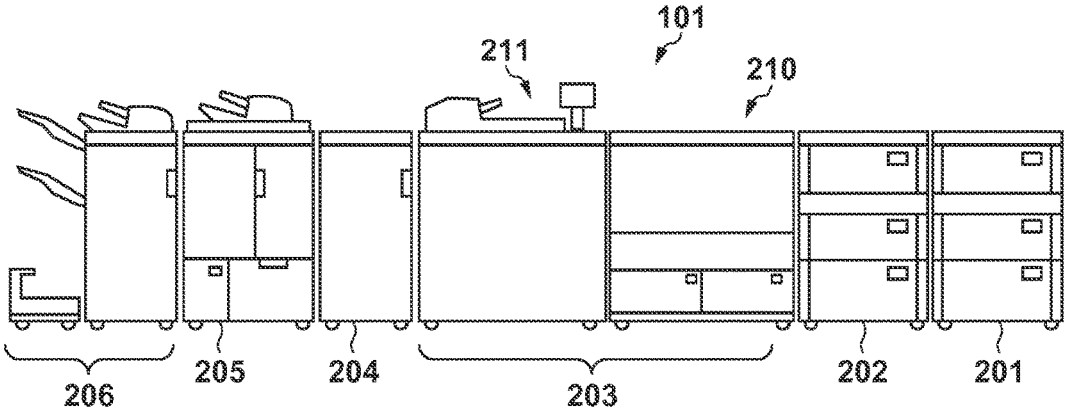
FIG. 2 is a view for showing a configuration of an image forming apparatus.

FIG. 2 is a view for showing a configuration of the image forming apparatus 101 according to embodiments.

The image forming apparatus 101 is provided with sheet feeding apparatuses 201 and 202 which are arranged externally, an image forming apparatus main body 203, a creaser apparatus 204, a case binding apparatus 205, and a finisher apparatus 206. The image forming apparatus main body 203 is equipped with an upstream side image forming unit 210, and a downstream side fixing and scanner unit 211.

The external sheet feeding apparatuses 201 and 202 are large capacity sheet feeding apparatuses capable of supplying the image forming apparatus main body 203 with a large number of media items. The image forming apparatus main body 203 is a printing apparatus which perform printing to media fed from the external sheet feeding apparatuses 201 and 202 or a sheet feeding tray built into the image forming apparatus main body 203. The creaser apparatus 204 applies a crease to media. The case binding apparatus 205 performs case binding. The finisher apparatus 206 is able to execute finishing processing such as punching or stapling, and saddle stitch binding.

Figure 3:
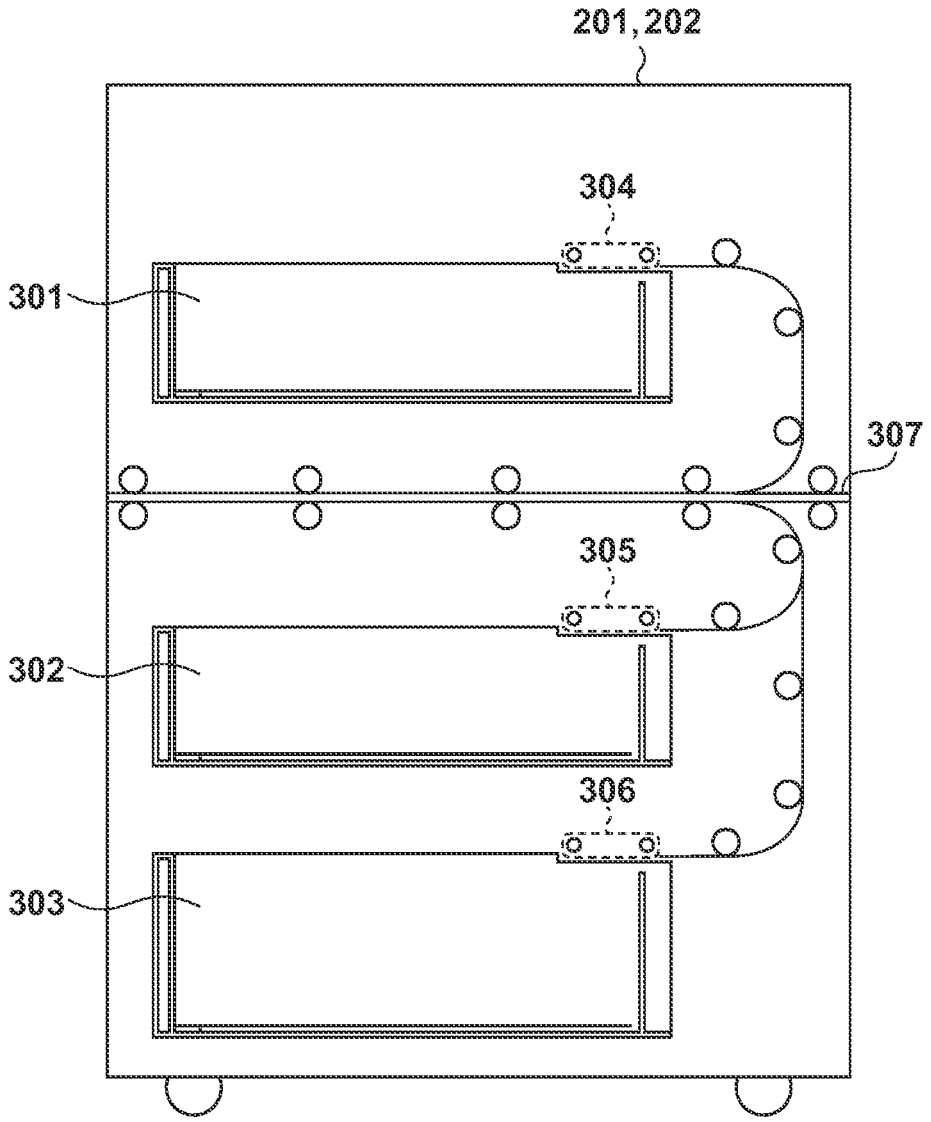
FIG. 3 is a cross-sectional view of a sheet feeding apparatus.

FIG. 3 is a cross-sectional view of the sheet feeding apparatus 201 according to embodiments. Note that because the configuration of the sheet feeding apparatus 202 is the same, its explanation will be omitted.

A straight path 307 is a path that conveys media that was conveyed from a sheet feeding tray 301, a sheet feeding tray 302, a sheet feeding tray 303, or from an upstream side to an apparatus on the downstream side. In the present embodiment, the external sheet feeding apparatus 201 and the image forming apparatus main body 203 are arranged on the upstream side of the external sheet feeding apparatus 202 and the downstream side of the external sheet feeding apparatus 202 respectively. For this reason, the external sheet feeding apparatus 202 conveys the media contained in the sheet feeding trays 301-303, or media conveyed from the external sheet feeding apparatus 201 to the image forming apparatus main body 203 through the straight path 307. The sheet feeding trays 301-303 are trays for feeding media. Each sheet feeding tray is able to bring media that it contains into contact with corresponding sheet feed rollers 304-306 by lifting up a lower part of the sheet feeding tray by a lift up motor (not shown). Each of the sheet feed rollers 304-306 is a roller for pulling media contained in corresponding sheet feeding trays 301, 302 and 303 out one sheet at a time, and the media that is pulled out by the rotation of these rollers is sent to the straight path 307 and conveyed.

Figure 4A:
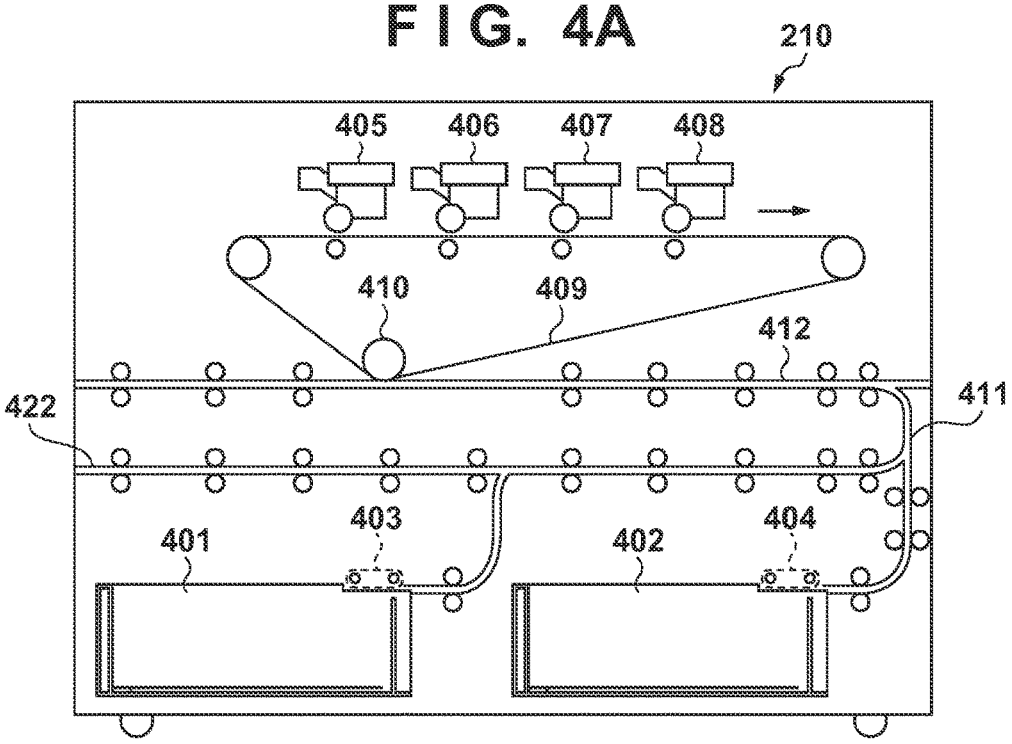
FIG. 4A and FIG. 4B are cross-sectional views of an image forming apparatus main body.
Figure 4B:
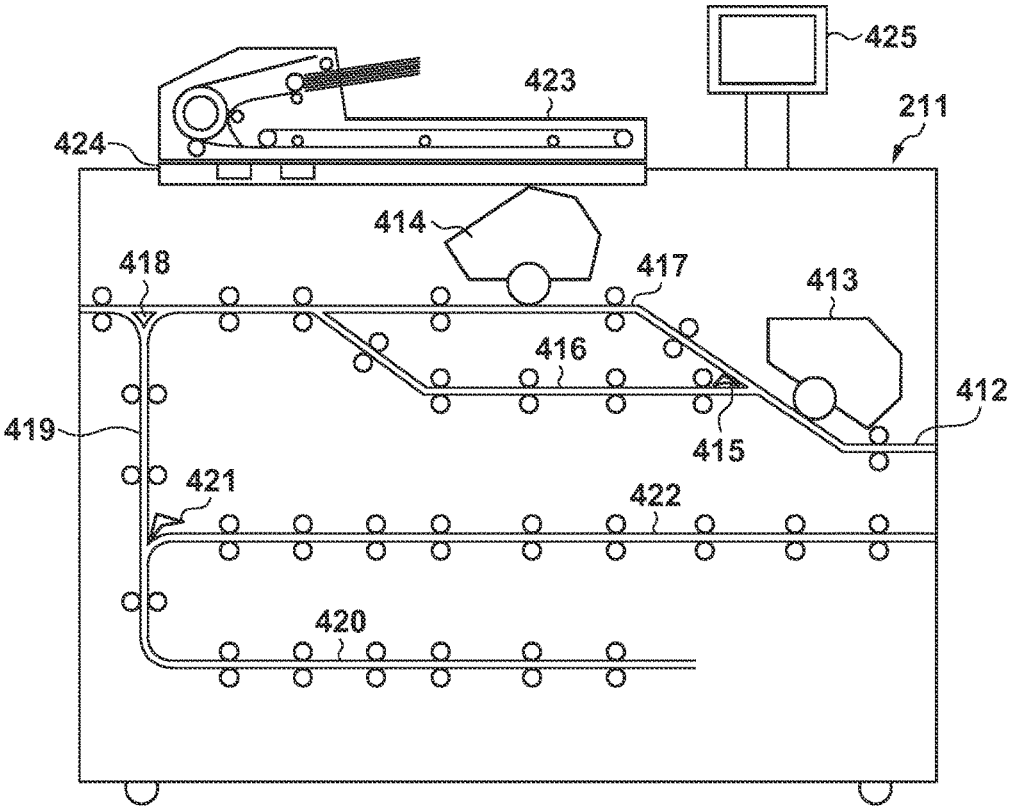

FIG. 4A and FIG. 4B are cross-sectional views of the image forming apparatus main body 203.

FIG. 4A shows a structure of the image forming unit 210 which is on the upstream side of the image forming apparatus main body 203, and FIG. 4B shows a configuration of the fixing and scanner unit 211 which are on the downstream side of the image forming apparatus main body 203. Here, the image forming unit 210 on the upstream side is connected to the external sheet feeding apparatus 202, and the fixing and scanner unit 211 on the downstream side is connected to the creaser apparatus 204.

A sheet feeding tray 401 and a sheet feeding tray 402 are trays for containing media and for feeding that media. By lifting up the lower part of the sheet feeding trays by a lift up motor (not shown), it is possible to bring the media that is contained into contact with a sheet feed roller 403 or a sheet feed roller 404. The sheet feed roller 403 and the sheet feed roller 404 are rollers for pulling media contained in the sheet feeding tray 401 and the sheet feeding tray 402 respectively out one sheet at a time. The media contained in the sheet feeding trays 401 and 402 is sent out to a conveying path by rotation of the sheet feed rollers 403 and 404 respectively, and conveyed until a conveying path 411. A conveying path 412 is a path for conveying media until a secondary transfer position 410. Also, the conveying path 412 is connected to a straight path of the external sheet feeding apparatus 202. With this, media conveyed from the conveying path 411, and media conveyed on the straight path 307 of the external sheet feeding apparatus 202 is conveyed to the conveying path 412.

Developing units 405-408 are developing units for forming images, and each is equipped with a station for one of the four colors Y, M, C and K. An image formed here is primary transferred to an intermediate transfer belt 409 which is rotating in a clockwise direction in the figure, and is transferred to media that is conveyed on the conveying path 412 at the secondary transfer position 410. The media, having had the image transferred onto it in this way, is conveyed through the conveying path 412 until a first fixing unit 413. In the first fixing unit 413, the transferred image is caused to be fixed to the media by applying heating and pressurization to the media to which the image has been transferred.

A flapper 415 sorts the media that passes through the first fixing unit 413 onto either a conveying path 416 or a conveying path 417. The flapper 415 is configured to be pivotable around the center of a pivot shaft, and the flapper 415 determines the conveyance direction of the media. When the flapper 415 pivots in a clockwise direction in the figure, the media is conveyed to the conveying path 417, and when the flapper 415 pivots in a counterclockwise direction in the figure, the media is conveyed to the conveying path 416. Whether media that has passed through the first fixing unit 413 is conveyed to the conveying path 416 or to the conveying path 417 is determined based on a condition related to the kind of the media (the size of its grammage, or the like). In a case where it is determined that it is necessary to perform fixing once again for the media, the media is conveyed to the conveying path 417 and in a case where it is determined that it is not necessary to perform fixing once again, the media is conveyed to the conveying path 416. A second fixing unit 414 is an apparatus for once again applying heating and pressurization to media conveyed on the conveying path 417.

A discharge flapper 418 is used for conveying media conveyed from the conveying path 417 or the conveying path 416 to the creaser apparatus 204 or a conveying path 419. The discharge flapper 418 is configured to be pivotable around the center of a pivot shaft, and the discharge flapper 418 determines the conveyance direction of the media. When the discharge flapper 418 pivots in a clockwise direction in the figure, the media is conveyed to the creaser apparatus 204, and when it pivots in a counterclockwise direction as in the figure, the media is conveyed to the conveying path 419. The media that was conveyed by the conveying path 419 is conveyed to a reversing path 420. Then by switchback processing, the conveyance direction of the media is changed 180 degrees. A flapper 421 is configured to be pivotable around the center of a pivot shaft, and determines the conveyance direction of the media. When the flapper 421 is pivoted in a clockwise direction in the figure, the media that was conveyed from the reversing path 420 is conveyed to a conveying path 422. The conveying path 422 is connected through the conveying path 411 in FIG. 4A. In this way the media reversed by the reversing path 420 has a front/back reversal of its printing surface, and is sent to the secondary transfer position 410. By this arrangement, it is possible for the image forming apparatus main body 203 to perform double-sided printing.

In a case where the flapper 421 is pivoted in a counterclockwise direction in the figure, the media passes through the conveying path 419. Then, once the discharge flapper 418 is pivoted in the counterclockwise direction in the figure, the media is conveyed to the creaser apparatus 204. In other words, since the media is reversed in the reversing path 420, it is possible for the media to be conveyed to the creaser apparatus 204 in a state where the fixed image faces downward. Note that in the case that the media is conveyed to the creaser apparatus 204 in a state where the fixed image faces upwards, it is possible not to use the reversing path 420.

An automatic document feeder (ADF) 423 is a document feeder that divides sequentially in page order, starting from the first page of an original document of a batch of original documents set in a stacking surface of an original document tray, and scans the original documents using a scanner 424. The scanner 424 irradiates the original document conveyed from the automatic document feeder 423 with a light source (not shown), scans the original document image with a CCD (not shown) and generates image data of the original document. In this way image processing is applied to the generated image data, and the image is transferred to the media by the developing units 405-408. In this way a copy operation is performed.

An operation panel 425 comprises an operation panel touch panel function included with the image forming apparatus main body 203, and is used to perform setting to the image forming apparatus 101 and to start a copy operation.

Figure 5:
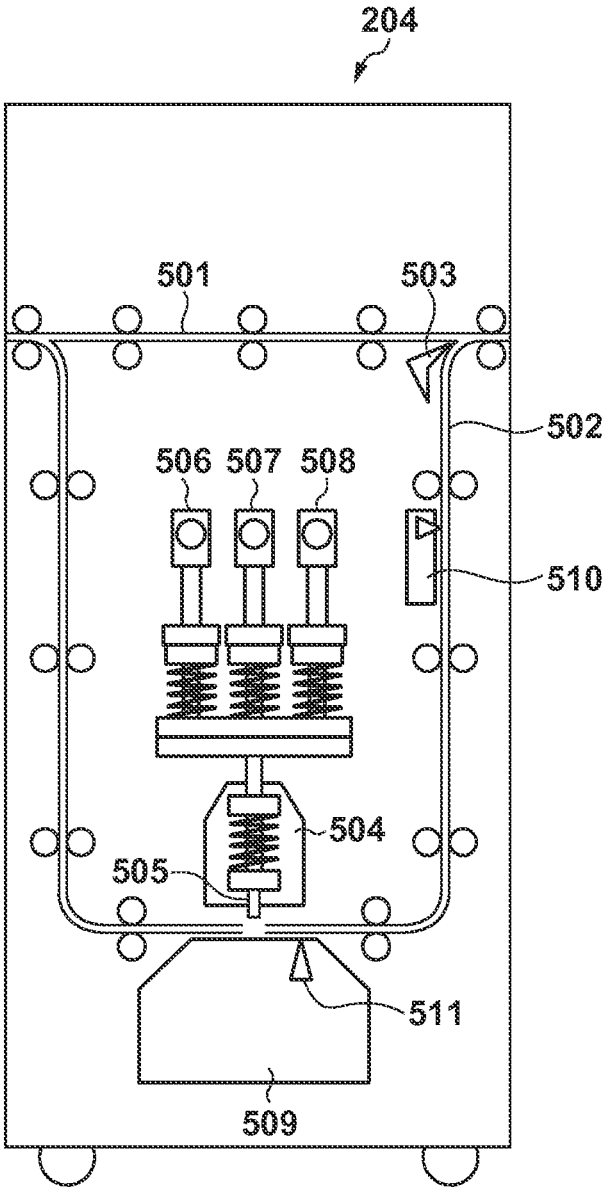
FIG. 5 is a cross-sectional view of a creaser apparatus.

FIG. 5 is a cross-sectional view of the creaser apparatus 204 according to embodiments.

A straight path 501 is a path for conveying media that was conveyed from an upstream side to a downstream side. In the present embodiment, media received from the image forming apparatus main body 203 is conveyed to the case binding apparatus 205. A conveying path 502 is a conveying path for conveying media that performs the creasing processing. A flapper 503 is for sorting media conveyed from the image forming apparatus main body 203 to the straight path 501 or the conveying path 502. The flapper 503 is configured to be pivotable around the center of a pivot shaft, and determines the conveyance direction of the media. When the flapper 503 pivots in a clockwise direction in the figure, the media is conveyed to the straight path 501, and when it pivots in a counterclockwise direction in the figure, the media is conveyed to the conveying path 502.

A creasing die 504 is a die for applying creasing processing to media, and comprises a creasing blade 505 for applying a crease (creasing). Note that, the creasing die 504 is detachably attachable to the creaser apparatus 204, and the creasing die 504 can detect whether or not the creaser apparatus 204 is attached by a sensor (not shown). Pressure apparatuses 506-508 are apparatus for applying pressure to the creasing die 504. A base 509 is a base for receiving the creasing blade 505. A conveying speed control unit 510 controls a conveying speed of media to be a predefined speed, and comprises a sensor inside the unit to detect a conveying speed of the media. A detection sensor 511 is a sensor for detecting a leading edge of media that is being conveyed.

In the case that a crease is being applied to media, the following operations may be performed by the creaser apparatus 204.

Firstly, the conveying speed control unit 510 comprises a sensor for detecting a conveying speed of media, and accelerates/decelerates a speed such that the conveying speed of the media passing through the conveying path 502 becomes a predetermined speed. Then, once the leading edge of the media that was conveyed at the predetermined speed is detected by the detection sensor 511, the pressure apparatuses 506-508 apply pressure to the creasing die 504 from an upper side to a lower side in the figure. Note that, for the pressure apparatuses 506-508, it is possible that there is only a single apparatus operation, or a plurality of linked operations, thereby making it possible to control the pressure applied to the creasing die 504. The pressure applied to the creasing die 504 by the pressure apparatuses 506-508 is transferred to the creasing blade 505. Then, the creasing blade 505 moves from the upper side to the lower side in the figure, and by sandwiching the media between the creasing blade 505 and the base 509, realizes a crease (creasing).

Note that, it is possible for the creaser apparatus 204 to apply a crease at a particular location in a conveyance direction of the media. More specifically, it is possible to realize this by performing the following control.

The media being conveyed by the conveying path 502 is controlled to a default conveying speed by the conveying speed control unit 510. Also, the timing to perform the creasing by the creasing blade 505 can be calculated by dividing on a value that is obtained by adding a creasing position (a distance from the leading edge of the media) to a distance between the detection sensor 511 and the creasing blade 505 by the default conveyance speed. In other words, the timing at which the leading edge of the media is detected by the detection sensor 511 is used as a standard, and using the calculated timing, the pressure apparatuses 506-508 are driven such that the creasing blade 505 is pressed onto the media.

Figure 6:
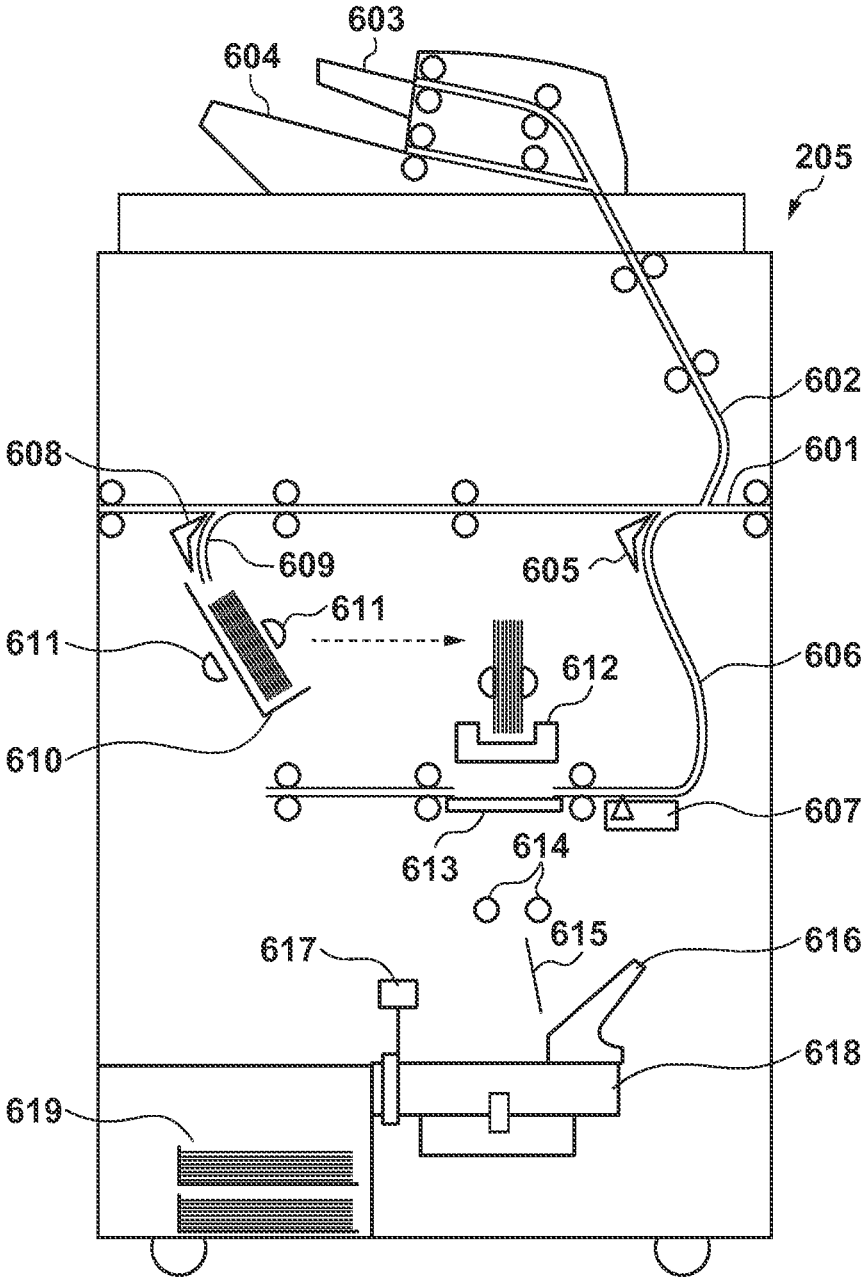
FIG. 6 is a cross-sectional view of a case binding apparatus.

FIG. 6 is a cross-sectional view of the case binding apparatus 205 according to embodiments.

A straight path 601 is a path for conveying media that was conveyed from an upstream side to a downstream side. For the present embodiment the media received by the creaser apparatus 204 is conveyed to the finisher apparatus 206. A conveying path 602 is a conveying path for conveying media that was fed to inserter trays 603 and 604 to the straight path 601. In the case that a case binding is to be generated using printed media, the inserter trays 603 and 604 are trays for feeding printed media.

A flapper 605 is for sorting media that was conveyed from the creaser apparatus 204 and the inserter trays 603 and 604 to the straight path 601 or a conveying path 606. The flapper 605 is configured to be pivotable around the center of a pivot shaft, and the flapper 415 determines the conveyance direction of the media. When the flapper 605 pivots in a clockwise direction in the figure, the media is conveyed to the straight path 601, and when it pivots in a counterclockwise direction in the figure, the media is conveyed to the conveying path 606. A conveying speed control unit 607 comprises a sensor for detecting a leading edge of media, and a function for stopping conveying of the media after the sensor detects that the leading edge of the media has been conveyed beyond a particular distance. A flapper 608 is for sorting media that was conveyed from the straight path 601 to the straight path 601 or a conveying path 609. The flapper 608 is configured to be pivotable around the center of a pivot shaft, and the conveyance direction of the media is determined. When the flapper 608 pivots in the clockwise direction as in the figure, the media is conveyed to the straight path 601. When the flapper 608 pivots in the counterclockwise direction as in the figure, the media is conveyed to the conveying path 609. The conveying path 609 is a conveying path for conveying media to a media stacking unit 610.

The media stacking unit 610 is a unit for stacking an inner sheet of a case binding. The media stacking unit 610 is formed in the form of a Japanese character "Ko" where the front surface side is open, and comprises a function for movement from the front surface side to the back surface side. A clipper set 611 grips a stacked inner sheet bundle in the media stacking unit 610, and after gluing the inner sheet bundle by a gluing unit 612, conveys them to a forming roller pair 614. The gluing unit 612 is a unit that dissolves a glue used for gluing a cover of a case binding and an inner sheet bundle of a case binding. The gluing unit 612 stores the dissolved glue within the unit while the case binding apparatus is operating; furthermore, it comprises a function for movement from the front surface side to the back surface side. A gluing base 613 is a gluing base that is used when gluing an inner sheet bundle and a cover that have dissolved glue adhered to them, and comprises a function for movement from the front surface side to the back surface side. The forming roller pair 614 forms the glued inner sheet bundle and cover in the shape of a case binding. The forming roller pair 614 rotates a pair of rollers in a direction that presses out from an upper side towards a lower side. For this reason, the forming roller pair 614 receives the glued inner sheet bundle and the cover from the clipper set 611, and with the spine cover side of the case binding on the bottom side, drops the formed case binding along a guide 615 into a turn table 618.

The guide 615 is a guide for dropping so that the spine cover of the formed case binding faces in a direction of a width gathering unit 616. The width gathering unit 616 performs adjustment of position of the formed case binding for a cutter 617 to perform disconnection. The cutter 617 is a cutter for trimming an edge, top or bottom of the formed case binding. The turn table 618 comprises a function for rotating the formed case binding, and is a device that enables the trimming of the edge, top or bottom of the case binding with only the cutter 617, when trimming the edge, top or bottom of a case binding. A basket unit 619 is a storage location for storing a bookbinding product of the case binding that has been trimmed.

Below, an explanation will be given more specifically for operation when generating a case binding.

Media that forms a cover of a case binding is conveyed to the conveying path 606 by the flapper 605. Then, by the conveying speed control unit 607, the central position of the media that is to become the cover of the case binding is controlled such that conveyance is stopped at a position that is at the center of the spine cover of the case binding. More specifically, the media that is to become the cover of the case binding is arranged on the gluing base 613. On the other hand, the media that is an inner sheet of a case binding is conveyed to the media stacking unit 610 via the conveying path 609 by the flapper 608, after being conveyed by the flapper 605 to the straight path 501. In this way, once the entire inner sheet bundle is aligned, the clipper set 611 grips the inner sheet bundle, and next, the media stacking unit 610 moves from the front surface side to the back surface side. At this time, since the clipper set 611 is positioned at the open part of the "Ko" character form of the media stacking unit 610, it becomes possible to move the inner sheet bundle to the gluing unit 612 by moving the media stacking unit 610 to the back surface side.

The clipper set 611 rotates such that the direction of the spine cover of the inner sheet bundle faces in a downward direction, moves toward the gluing unit 612 and performs the gluing. Once gluing is completed, the clipper set 611 first moves the inner sheet bundle in an upward direction; furthermore, the gluing unit 612 moves from the front surface side to the back surface side. Once moving of the gluing unit 612 is complete, the clipper set 611 moves in a downward direction, and causes the media that is to become the cover of the case binding that was arranged on the gluing base 613 to adhere to the inner sheet bundle. In this way, after gluing is complete, the gluing base 613 moves from the front surface side to the back surface side, and once the move is complete, the clipper set 611 moves in a downward direction, and forming of the case binding is performed by the forming roller pair 614.

In this way, since the formed case binding, is pushed out in a downward direction by the form roller pair 614 along the guide 615, the spine cover side is arranged on top of the turn table 618 facing the width gathering unit 616. The position of formed case binding that lies on top of the turn table 618 is aligned by the width gathering unit 616, and the part that becomes the edge is trimmed by the cutter 617. Next, the turn table 618 rotates 90 degrees, and performs alignment at the width gathering unit 616, and the part that is to be the top is trimmed. Furthermore, the turn table 618 rotates 180 degrees, and performs alignment at the width gathering unit 616, and part that is to be the bottom is trimmed. In this way the trimmed bookbinding product of the case binding is pressed to the left side in the figure by the width gathering unit 616, and into the basket unit 619.

Figure 7:
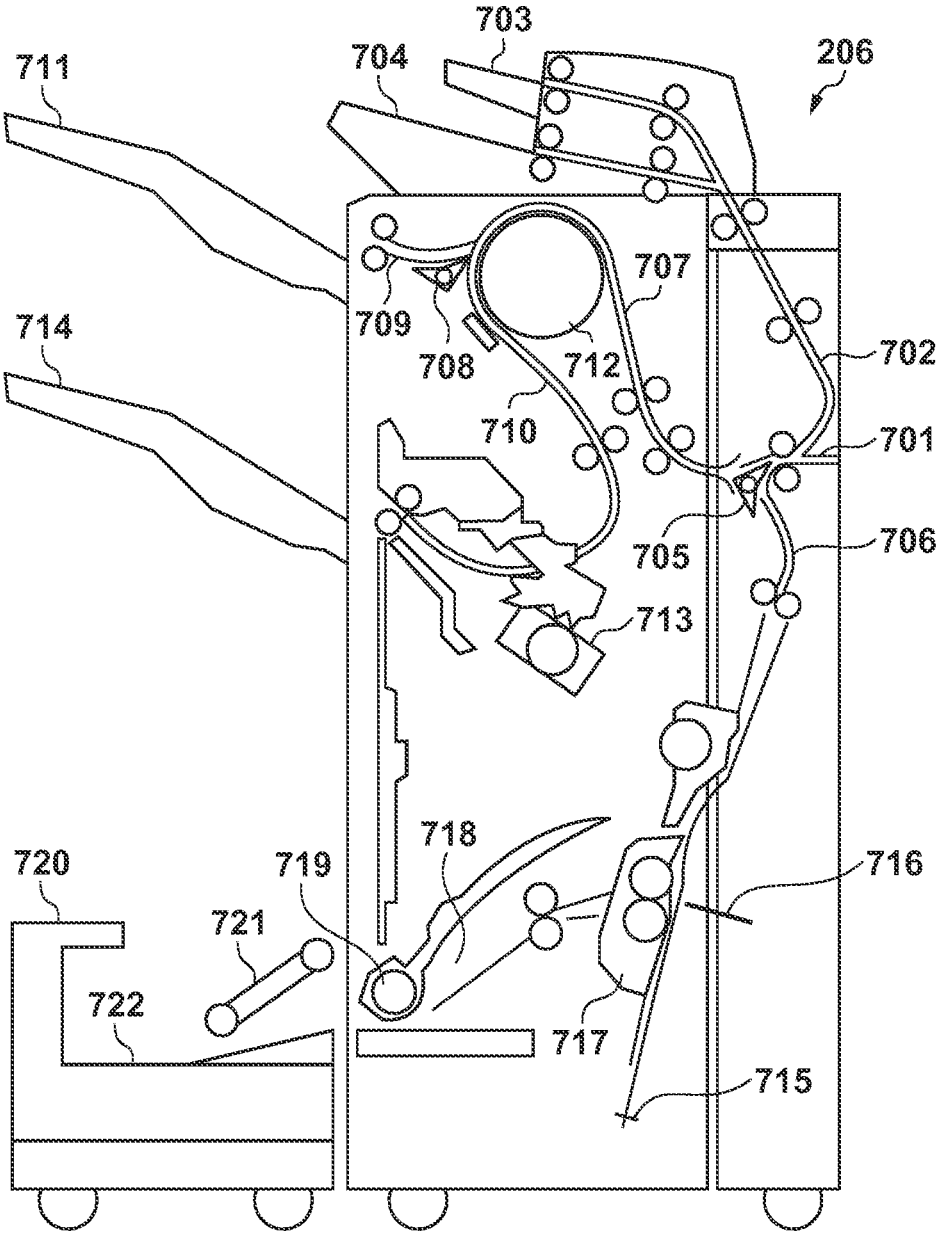
FIG. 7 is a cross-sectional view of a finisher apparatus.

FIG. 7 is a cross-sectional view of the finisher apparatus 206 according to embodiments.

A conveying path 701 is a path for conveying media conveyed from an upstream side to the finisher apparatus 206. According to the present embodiment, the finisher apparatus 206 receives the media conveyed from the straight path 601 of the case binding apparatus 205 and conveys it to the inside of the finisher apparatus 206. A conveying path 702 is a conveying path for conveying media that was fed to inserter trays 703 and 704 to the conveying path 701. The inserter trays 603 and 604 are trays that feed printed media in the case of using printed media for punching, stapling, or generating a bookbinding product such as a saddle stitch binding.

A flapper 705 is configured so as to be pivotable about a center of a pivot shaft, and defines the conveyance direction of the media conveyed by the conveying path 701 or the conveying path 702. When the flapper 705 pivots in the counterclockwise direction in the figure, the media is conveyed to a conveying path 706. When the flapper 705 pivots in the clockwise direction in the figure, the media is conveyed to a conveying path 707. A flapper 708 is configured so as to be pivotable about a center of a pivot shaft and defines a conveyance direction of the media that was conveyed by the conveying path 707. When the flapper 708 pivots in a counterclockwise direction in the figure, the media is conveyed to a conveying path 710. When the flapper 708 pivots in the clockwise direction in the figure, the media is conveyed to a conveying path 709. The conveying path 709 is a conveying path for conveying media to a sample tray 711. The conveying path 710 is a conveying path for conveying media to a stack tray 714. Sample tray 711 is a tray where media that has passed through the conveying path 709 is discharged. The media conveyed to the conveying path 710 passes through a puncher 712 and a stapler 713, and is conveyed to the stack tray 714.

The puncher 712 applies a punch pressing process to the media that passes through the conveying path 710. The puncher 712 comprises of interchangeable two hole and three hole blades (not shown), and by interchanging the blades, it is possible to open a particular number of holes in the media. The stapler 713 stacks media that passes through the conveying path 710, and applies the stapling processing. The stapler 713 comprises replenishable blades (not shown), and makes possible various stapling processes such as corner stapling, two location stapling, or the like. Stack tray 714 is a tray where media that has passed through the conveying path 710 is discharged.

The conveying path 706 is a conveying path for conveying media in the case that saddle stitching processing is applied. A stopper 715 is a stopper for stopping media that has been conveyed from the conveying path 706. The stopper 715 can adjust the length between the stopper 715 and a folding plate 716 by a motor (not shown). Normally, a length is configured that is one half the length of the conveyance direction of the media to which saddle stitching processing is being applied to. In other words, the saddle stitching processing is applied to the center of the media to which the saddle stitching processing is applied. The folding plate 716 is a device for pressing media that has been stopped by the stopper 715 to a saddle stitcher 717. The saddle stitcher 717 applies folding processing and stapling processing to the pushed media by the folding plate 716. The middle of the media is folded by the operation by the stopper 715 and the folding plate 716, and enters the saddle stitcher 717. For this reason, once the media to which saddle stitching processing has been applied to have passed through the saddle stitcher 717, it is conveyed to a stacking unit 718. Then, the media to which saddle stitching processing has been applied to is discharged from the stacking unit 718 to a saddle tray 720 by a discharging roller 719. A guide 721 has an operation for storing the media to which saddle stitching processing has been applied, and sending one book at a time sequentially to a saddle stacking unit 722. The saddle stacking unit 722 is for storing media to which saddle stitching processing has been applied in great quantities.

Figure 8:
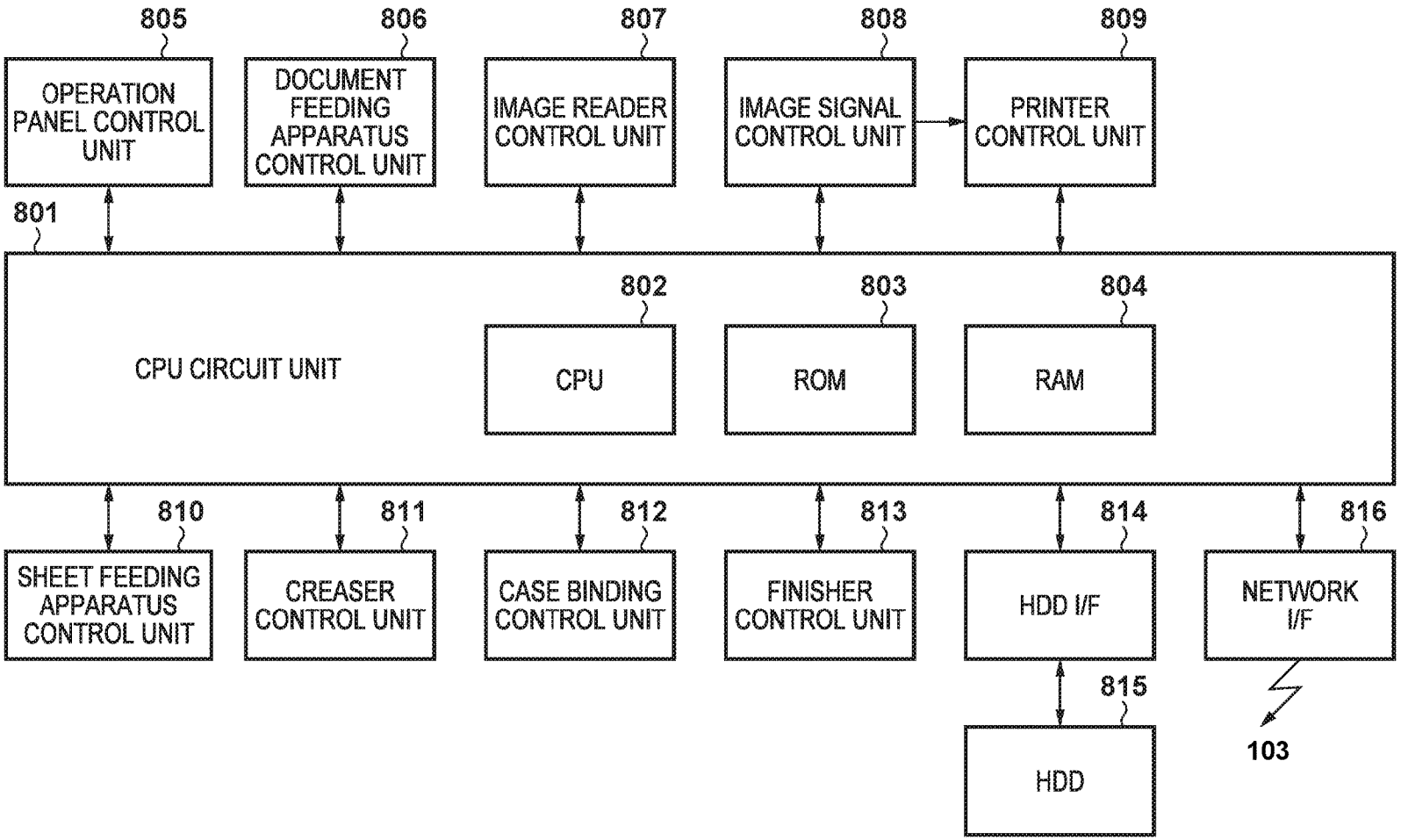
FIG. 8 is a block diagram for explaining a hardware configuration of the image forming apparatus.

FIG. 8 is a block diagram for explaining a hardware configuration of the image forming apparatus 101 according to the embodiment.

A CPU circuit unit 801 comprises a CPU 802, and controls each control unit shown next, according to programs stored in a ROM 803. An operation panel control unit 805, a document feeding apparatus control unit 806, an image reader control unit 807, an image signal control unit 808, a printer control unit 809, and a sheet feeding apparatus control unit 810, which are control units relating to printing, are controlled. Control of a creaser control unit 811, a case binding control unit 812, and a finisher control unit 813 which are control units related to forming a printed material is performed. Furthermore, control of an HDD I/F unit 814 and a network I/F unit 816 for controlling an HDD 815 is performed as part of an internal and an external interface control unit. A RAM 804 is used as a region to temporarily store control data and as a work area for calculation accompanying control.

The operation panel control unit 805 controls the operation panel 425. The document feeding apparatus control unit 806 controls the automatic document feeder (ADF) 423. The image reader control unit 807 controls the scanner 424. The image signal control unit 808, after applying image processing to received image data, converts the image data into an image signal that can be interpreted by the printer control unit 809, and performs control to pass the result to the printer control unit 809. The printer control unit 809 controls the developing unit 405, the developing unit 406, the developing unit 407, the developing unit 408, the first fixing unit 413, and the second fixing unit 414. The sheet feeding apparatus control unit 810 controls the external sheet feeding apparatus 201, the external sheet feeding apparatus 202, and the sheet feeding tray of the image forming apparatus main body 203.

The creaser control unit 811 controls the creaser apparatus 204. The case binding control unit 812 controls the case binding apparatus 205. The finisher control unit 813 controls the finisher apparatus 206. The HDD I/F unit 814 is an interface between the CPU circuit unit 801 and the HDD 815, and controls writing and reading for the HDD 815. The network I/F unit 816 control transmission/reception of data via the network 103. The HDD 815 is a bulk storage unit and an area for storing non-volatile data. The network I/F unit 816 is connected to the image processing apparatus 102 (FIG. 1) via the network 103.

An explanation will be given for control for each control unit by the CPU circuit unit 801 during a copy operation.

The CPU circuit unit 801 makes an instruction to the automatic document feeder (ADF) 423 via the document feeding apparatus control unit 806 when it receives a copy instruction from the operation panel control unit 805, and feeds a batch of original documents one sheet at a time. Then, the CPU circuit unit 801, using the image reader control unit 807, causes the scanner 424 to generate original document scan image data. Next, the CPU circuit unit 801 temporarily saves the generated image data to the RAM 804, and transfers the image data to the image signal control unit 808. Then the printer control unit 809 converts to an image signal that can be interpreted by the image signal control unit 808, and the CPU circuit unit 801 instructs that the image signal be passed to the printer control unit 809. At the same time, the CPU circuit unit 801 uses the sheet feeding apparatus control unit 810 and instructs that media for printing be fed from the external sheet feeding apparatus 201, the external sheet feeding apparatus 202, or the like.

The printer control unit 809 controls the developing unit 405, the developing unit 406, the developing unit 407, the developing unit 408, the first fixing unit 413, and the second fixing unit 414, and forms the image that was read out on the media that was fed in. Thereafter, post-processing is applied to the media on which the image is formed, according to an operator designated output format. Here, post-processing indicates processing that is applied by the creaser control unit 811, the case binding control unit 812, and the finisher control unit 813.

For example, in the case of applying creasing processing to media, the CPU circuit unit 801 uses the creaser control unit 811 to perform creasing processing on the media. After this, in the case of forming a case binding, the CPU circuit unit 801 uses the case binding control unit 812 and performs case binding formation processing and causes a result to be discharged to the basket unit 619. Also, in the case that the result is discharged to the finisher apparatus 206, the CPU circuit unit 801 uses the finisher control unit 813 and performs processing according to a designated paper discharge destination, and designated finishing settings, such as saddle stitching and two hole punching. Then, the media to which processing is applied is caused to be discharged to one of the sample tray 711, the stack tray 714, and the saddle stacking unit 722.

Next, an explanation will be given for control towards each control unit by the CPU circuit unit 801 during a print operation.

The CPU circuit unit 801 receives, for example, print image data from the image processing apparatus 102 via the network I/F unit 816. Next, the CPU circuit unit 801 temporarily saves the received image data to the RAM 804, and transfers the image data to the image signal control unit 808. Since after this the operation is the same as during the copy operation, explanation will be omitted.

Figure 9:
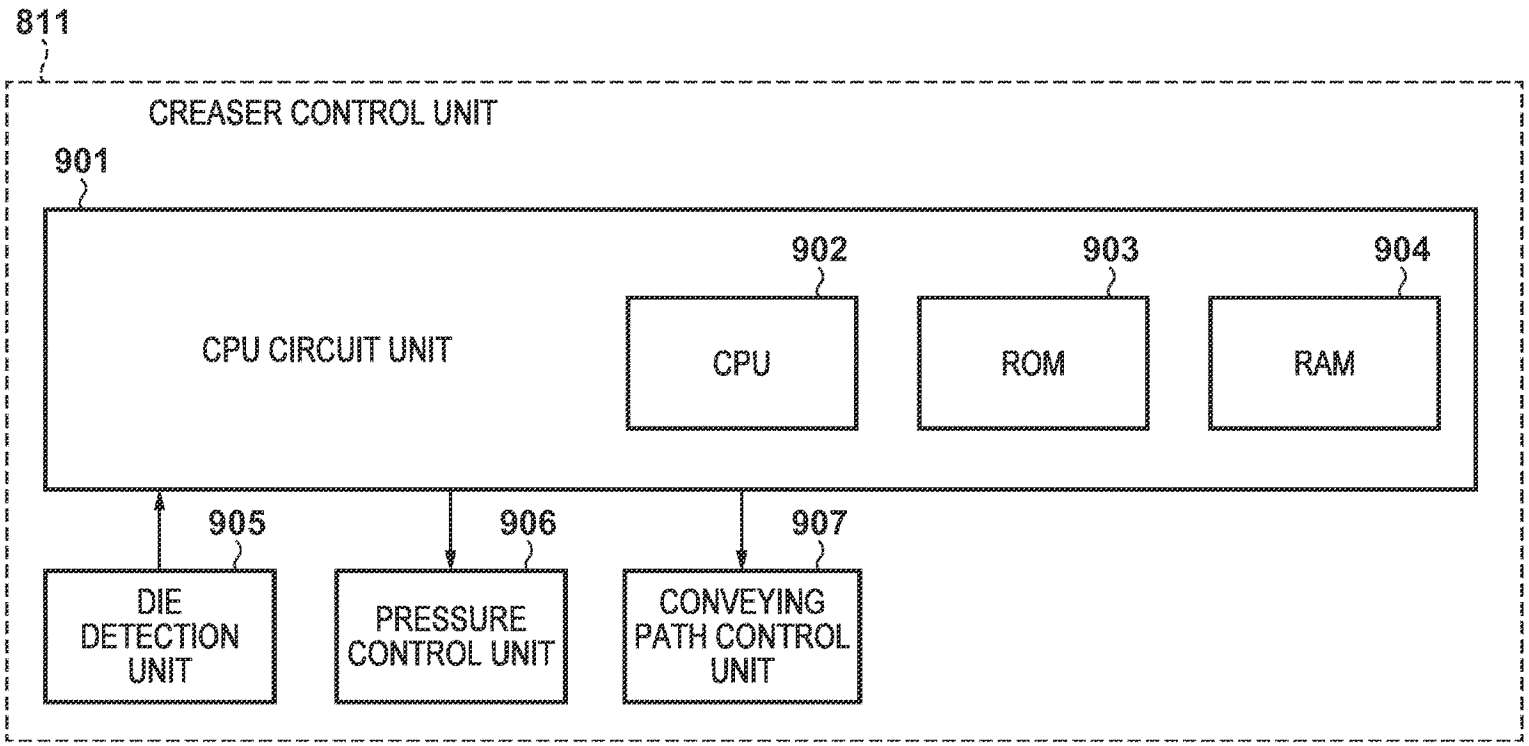
FIG. 9 is a block diagram for showing a detailed configuration of a creaser control unit.

FIG. 9 is a block diagram for showing a detailed configuration of the creaser control unit 811 according to the embodiment.

A CPU circuit unit 901 comprises a CPU 902, and controls each control unit shown next, according to programs stored in a ROM 903. The control units are a die detection unit 905, a pressure control unit 906 and a conveying path control unit 907. A RAM 904 is used as a region to temporarily store control data and as a work area for calculation accompanying control. The CPU circuit unit 901 is a mediating circuit between the CPU circuit unit 801 and the die detection unit 905, the pressure control unit 906 and the conveying path control unit 907. The CPU circuit unit 901 has a function for mediating instructions from the CPU circuit unit 801 and notifications from the control units.

The die detection unit 905 is a detection unit for detecting whether or not the creasing die 504 is attached to the creaser apparatus 204. The pressure control unit 906 controls the pressure apparatuses 506-508 and performs creasing by adding pressure to the creasing die 504. The conveying path control unit 907 controls the flapper 503 and the conveying speed control unit 510, and performs control of a conveying speed, and switching of a media conveying path. In other words, the CPU circuit unit 801 has a configuration that enables central control of the die detection unit 905, the pressure control unit 906 and the conveying path control unit 907 through the CPU circuit unit 901, and makes it possible to control creasing processing for the creaser apparatus 204 and to perform conveying path control.

Figure 10:
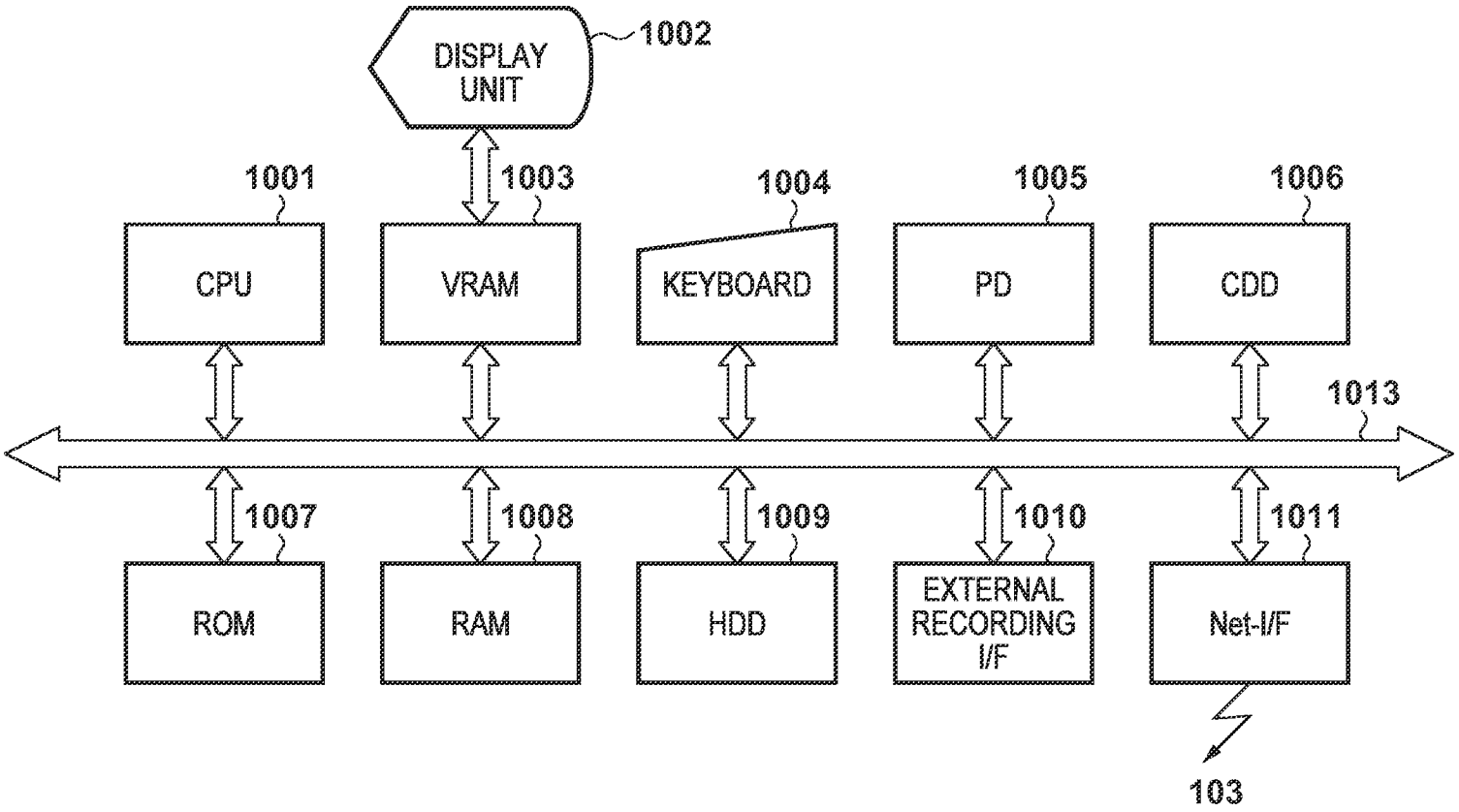
FIG. 10 is a block diagram for explaining a hardware configuration of an image processing apparatus.

FIG. 10 is a block diagram for explaining a hardware configuration of the image processing apparatus 102 according to the embodiment.

A CPU 1001 controls each device connected to a CPU device based on control programs stored in a ROM 1007, an HDD 1009, or a CDD 1006. On a display screen of a display unit 1002, for example, a window, an icon, a message, a menu, or other operator interface information, are displayed. A display image for displaying to the display unit 1002 is rendered on a VRAM 1003. The image data that is generated in the VRAM 1003 for display use is transferred according to a predetermined definition to the display unit 1002, and because of this an image is displayed to the display unit 1002. A keyboard 1004 comprises various keys for inputting characters. A PD (pointing device) 1005 is, for example, used for making an instruction on an icon, menu and other objects displayed on the display screen of the display unit 1002. A CDD (compact disk drive) 1006 is a device for performing reading/writing of various control programs and data between recording mediums such as a CD-ROM and CD-R. This may also be a DVD drive. The ROM (read only memory) 1007 stores various control programs and data. A RAM (random access memory) 1008 comprises a save region for data for error processing and a work area of the CPU 1001, and an area for loading control programs. For example, the image processing apparatus 102 comprises a function for RIPing electronic data and sending the result to the image forming apparatus 101. Such a program is stored in the ROM 1007, and when performing RIP processing, such a program uses the work area of the CPU 1001 and the RAM 1008. An HDD (hard disk drive) 1009 saves various data and various control programs. An external recording I/F 1010 performs reading/writing to an external recording medium such as a USB memory. A network interface (Net-I/F) 1011 performs transmission/reception of data via the network 103. In the present embodiment it is possible for the image processing apparatus 102 to perform transmission/reception of data with the image forming apparatus 101 via the network 103. A CPU bus 1013 includes an address bus, a data bus, and a control bus.

Figure 11:
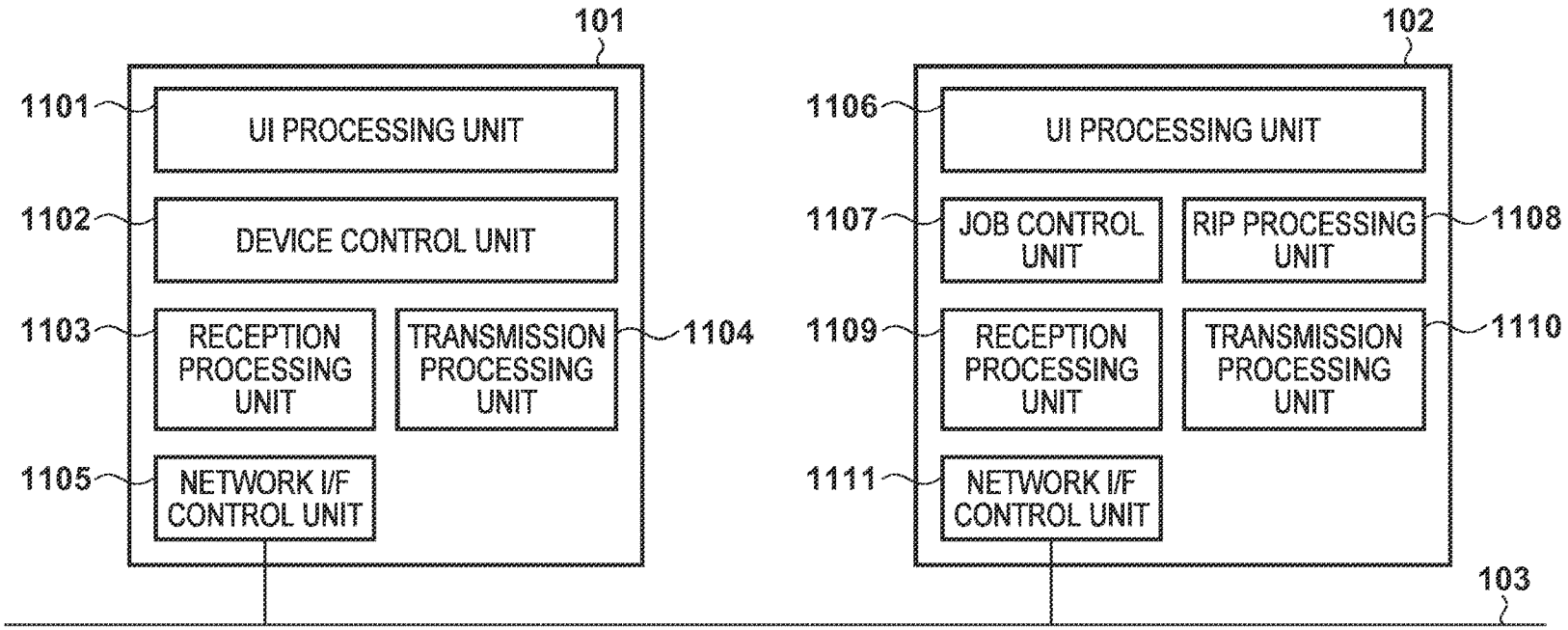
FIG. 11 is a block diagram for explaining a software configuration of the image forming apparatus and the image processing apparatus.

FIG. 11 is a block diagram for explaining a software configuration of the image forming apparatus 101 and the image processing apparatus 102 according to the embodiment.

A UI processing unit 1101, a device control unit 1102, a reception processing unit 1103, a transmission processing unit 1104, and a network I/F control unit 1105 are software that are executed on the CPU circuit unit 801 of the image forming apparatus 101. Also, a UI processing unit 1106, a job control unit 1107, a RIP processing unit 1108, a reception processing unit 1109, a transmission processing unit 1110, and a network I/F control unit 1111 are software that is executed on the CPU 1001 of the image processing apparatus 102.

First an explanation will be given for the configuration of the image forming apparatus 101.

The UI processing unit 1101 controls the operation panel control unit 805, and handles displaying setting screens related to the image forming apparatus 101 to the operation panel 425. Then, the UI processing unit 1101 handles processing for performing reading out and saving of setting values that are set on the setting screen to the HDD 815 of the image forming apparatus 101. The device control unit 1102 controls the CPU circuit unit 801 and handles processing such as that for an image forming function of the image forming apparatus main body 203, a creasing function of the creaser apparatus 204, case binding formation by the case binding apparatus 205, and saddle stitch binding generation by the finisher apparatus 206. Furthermore, the device control unit 1102 reads out settings related to printing from the HDD 815 of the image forming apparatus 101, and handles processing that is reflected in printing processing. The reception processing unit 1103 receives print images that are RIPed from the image processing apparatus 102 through the network I/F control unit 1105, and handles processing for passing print images to the device control unit 1102 in units of pages. The transmission processing unit 1104 sends events that occurred on the image forming apparatus 101 as well as status change notifications through the network I/F control unit 1105. The network I/F control unit 1105 controls the network I/F unit 816. Furthermore, it collaborates with the network I/F control unit 1111 of the image processing apparatus 102 and handles processing for data communication between the image forming apparatus 101 and the image processing apparatus 102 through the network 103.

Next an explanation will be given for the configuration of the image processing apparatus 102.

The UI processing unit 1106 handles processing for displaying a control setting screen on the display unit 1002 of the image processing apparatus 102 when the image forming apparatus 101 and the image processing apparatus 102 execute a print job. The job control unit 1107 handles the processing for transmitting the print job to the image forming apparatus 101. More specifically, it performs processing such as transmission of job setting information and a print job print initiation request. The RIP processing unit 1108 handles processing for RIPing the print data in units of pages. The reception processing unit 1109 receives status changes and events from the image forming apparatus 101 through the network I/F control unit 1111, and handles processing for passing these to the UI processing unit 1106. The transmission processing unit 1110 is responsible for processing for passing a RIP image to the reception processing unit 1103 of the image forming apparatus 101 through the network I/F control unit 1111 in units of pages. The network I/F control unit 1111 controls the Net-I/F 1011. Furthermore, it collaborates with the network I/F control unit 1105 of the image forming apparatus 101 and handles processing for data communication with the image forming apparatus 101 through the network 103.

In this kind of configuration, in the case of the image processing apparatus 102 RIPing a print job and printing on the image forming apparatus 101, the following processing is realized.

Firstly, the job control unit 1107 of the image processing apparatus 102 generates a print job according to the job settings that are set by the UI processing unit 1106. Next, the job control unit 1107 renders the print job by the RIP processing unit 1108 in units of pages, and sends the image data to the device control unit 1102 of the image forming apparatus 101 through the transmission processing unit 1110. Furthermore, the job control unit 1107 sends job setting information to the image forming apparatus 101 of the device control unit 1102 through the network I/F control unit 1111 in accordance with the sending of image data.

Next, the device control unit 1102 of the image forming apparatus 101 receives the received image data, and in addition to passing the image data to the image signal control unit 808, the device control unit 1102 receives job setting information. Then, the device control unit 1102 controls the printer control unit 809, the sheet feeding apparatus control unit 810, the creaser control unit 811, the case binding control unit 812, and the finisher control unit 813 based on the job setting information. Next the device control unit 1102 makes an instruction to a respective control unit relating to the sheet feeding tray, the discharge destination, the existence or absence of a crease, as well as the finishing format (a case binding, a saddle stitch binding, a punching, a stapling), or the like. At this time the device control unit 1102 reads out settings related to printing from the HDD 815 of the image forming apparatus 101, and reflects these in the print processing as necessary. Then, in addition to making an instruction as described above, it makes an instruction to the image signal control unit 808 such that the image data is passed to the printer control unit 809.

With the above, media on which an image is printed is generated as a printed material to which creasing processing is applied according to the job setting information and settings related to printing that are saved in the HDD 815.

Figure 12A:
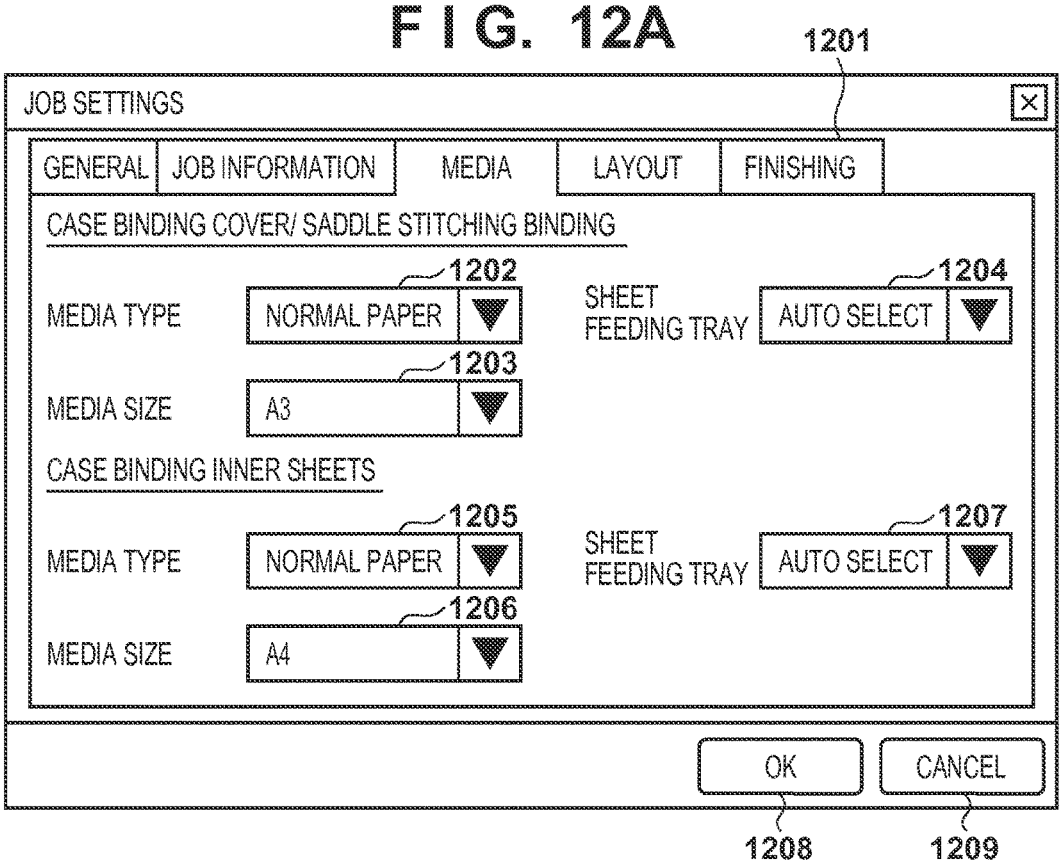
FIG. 12A and FIG. 12B are views for illustrating examples of job setting screens displayed on a display unit of the image processing apparatus.
Figure 12B:
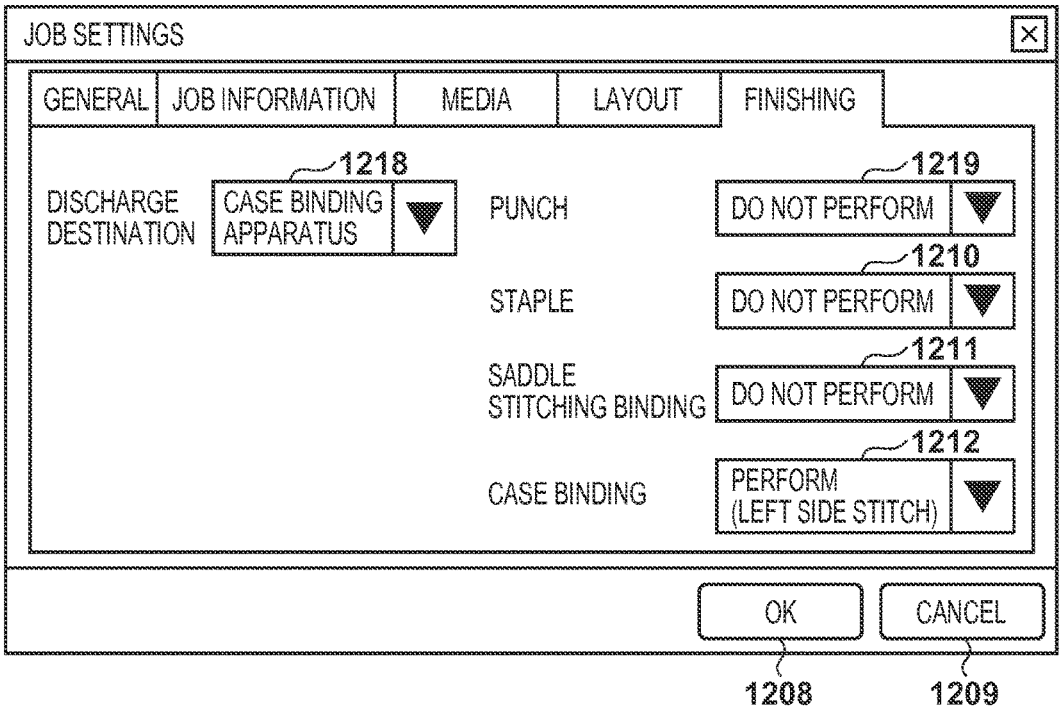

FIG. 12A and FIG. 12B are views for showing examples of a job setting screen that is displayed to the display unit 1002 of the image processing apparatus 102 according to the embodiment.

FIG. 12A is a view for illustrating an example of a job setting screen.

A tag 1201 is grouped into tags based on the job setting item type, and is comprised of 5 types: "general", "job information", "media", "layout", and "finishing". In FIG. 12A, "media" is selected and the setting items are displayed. "Media" is a tag which summarizes settings related to media used in a print job. A media type 1202, a media size 1203, and a sheet feeding tray 1204 are setting items related to media used for a case binding cover or a saddle stitch binding. In the figure, normal paper is selected for the media type 1202, and for the media size 1203 A3 is selected, while for the sheet feeding tray 1204, automatic selection is selected. In other words, in the settings in FIG. 12A, setting is performed such that feeding can be performed from any sheet feeding tray when printing if the media type is set to normal paper, and the size is set to A3 in the sheet feeding tray.

A media type 1205, a media size 1206 and a sheet feeding tray 1207 are setting items related to media used for a case binding inner sheet. In FIG. 12A, normal paper is selected for the media type 1205, A4 is selected for the media size 1206, and automatic selection is selected for a sheet feeding tray 1206. In other words, in the settings in the figure, setting is performed such that feeding can be performed from any sheet feeding tray when printing if the media type is set to normal paper, and the media size is set to A4 in the sheet feeding tray.

An OK button 1208 is a button for determining to set the contents set in this job setting screen as the job settings. A cancel button 1209 is button for discarding contents set in the job setting screen. Note that, if the OK button 1208 or the cancel button 1209 is pressed, the job setting screen is closed.

FIG. 12B is a view for illustrating an example of a "finishing" setting screen.

"Finishing" is a tag that summarizes settings related to paper discharging. Discharge destination 1218 is a setting related to discharge destination designation, and in the figure, the case binding apparatus is designated. Here, for this setting, in addition to the case binding apparatus, the sample tray 711, the stack tray 714, and the saddle stacking unit 722 of the finisher apparatus 206 are also selectable. A punch 1219 is an item for setting whether or not a punch pressing process is performed on media when discharging to the finisher apparatus 206. In the figure, for the punch, "do not perform" is designated. A staple 1210 is an item for setting whether or not stapling processing is performed on media when discharging to the finisher apparatus 206. In the figure, the staple setting is designated as "do not perform". A saddle stitch binding 1211 is an item for setting whether or not saddle stitching processing is performed on media when discharging to the finisher apparatus 206. In the figure, the saddle stitching processing is set to "do not perform". A case binding 1212 is an item for setting to form a case binding at the case binding apparatus 205. In the figure, the case binding is set such that it is formed with a left saddle stitching. Since the OK button 1208 and the cancel button 1209 are the same as the explanation for FIG. 12A, an explanation of these will be omitted.

Note that, the settings in the screens of FIG. 12A and FIG. 12B are saved to the HDD 1009 by the UI processing unit 1106 of the image processing apparatus 102 using the CPU 1001. Also, in the case of displaying, the UI processing unit 1106 performs read out processing from the HDD 1009.

Figure 13:
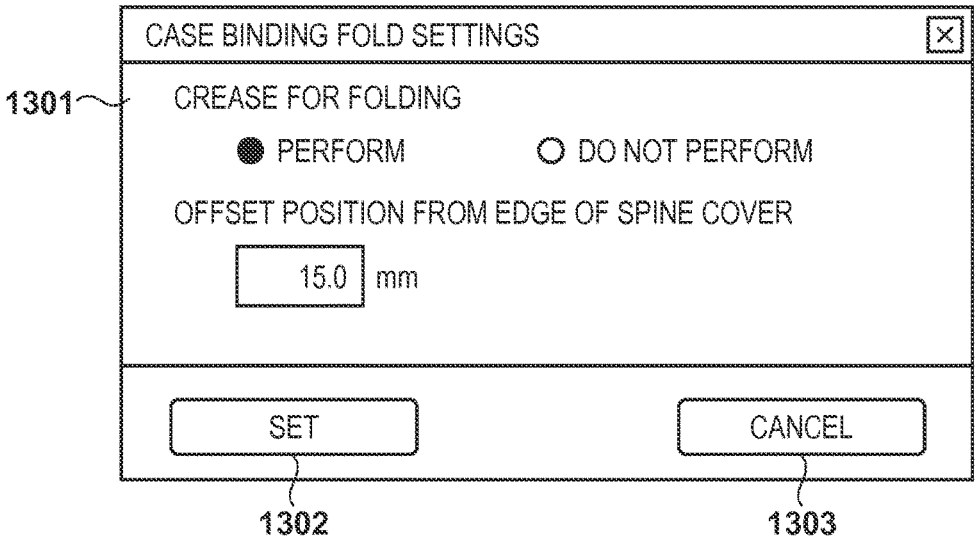
FIG. 13 is a view for illustrating an example of a case binding fold setting screen displayed on an operation panel of the image forming apparatus.

FIG. 13 is a view for illustrating an example of a fold setting screen for a case binding that is displayed to the operation panel 425 of the image forming apparatus 101 according to the embodiment.

A setting item 1301 shows a setting item relating to a folding setting (a creasing setting) upon the case binding. The setting item 1301 contains 2 items: a radio button setting of "crease for folding" and a setting of "offset position from edge of spine cover". First, one of the two options ("perform" or "do not perform") is selectable for the radio button setting of "crease for folding". Note, "perform" is selected in the example of FIG. 13. Also, a positive numerical value in the units of millimeters can be input for "offset position from edge of spine cover", and "15.0" is input in the example of FIG. 13. A determination button 1302 is a button pressed to finalize the radio button setting for "crease for folding" and the "offset position from edge of spine cover" setting. A cancel button 1303 is a button for discarding the radio button setting for "crease for folding" and the "offset position from edge of spine cover" setting.

Note, the settings by the screen of FIG. 13 are stored in the HDD 815 by the UI processing unit 1101 of the image forming apparatus 101 using the CPU circuit unit 801. Also, in the case of displaying, the UI processing unit 1101 performs read out processing from the HDD 815.

Figure 14A:
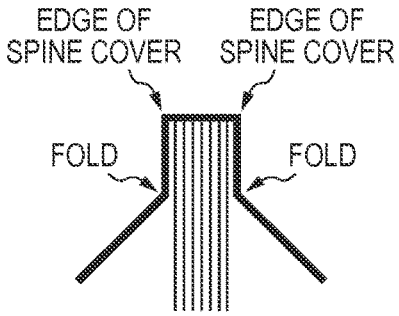
FIG. 14A and FIG. 14B are views for explaining a positional relationship between an edge of a spine cover and a fold regarding case binding in an embodiment.
Figure 14B:
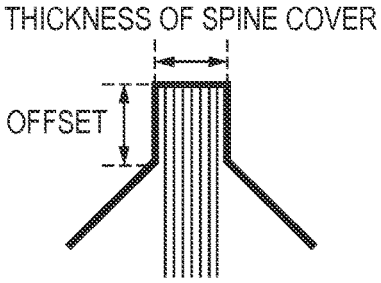
Figure 14C:
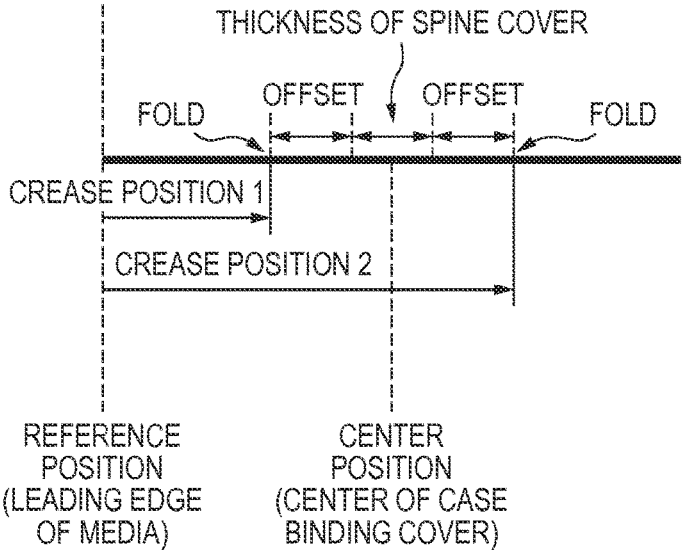
FIG. 14C is a view for showing a relationship between a thickness of the spine cover, a position of the fold, and a creasing position.

FIG. 14A-FIG. 14C are conceptual diagrams for explaining the fold in the cover of the case binding according to the embodiment. The terms "edge of spine cover", "fold" and "offset" in the first embodiment are clearly defined with reference to FIG. 14A-FIG. 14C. Furthermore, the relationship between "edge of spine cover", "fold", and "offset" and "creasing position 1" and "creasing position 2" is clarified.

FIG. 14A and FIG. 14B are views for explaining a positional relationship between an edge of a spine cover and a fold relating to the case binding. As shown in FIG. 14A, a fold is present in both a front cover and a back cover of the case binding. Also, a distance between the edge of the spine cover and the fold is referred to as an "offset", and further, the distance between the edges of the spine cover is referred to as the "thickness of the spine cover".

Note, the offset in FIG. 14B corresponds to "offset position from edge of spine cover" set by the setting item 1301 in FIG. 13. In the example of FIG. 13, the length of the offset in FIG. 14B is set to 15.0 mm.

FIG. 14C is a view for explaining where the position of the fold is located with respect to the basis position (the leading edge of a medium) on the cover of the case binding.

As explained in FIG. 6, a bundle of inner sheets is glued at a center point of the case binding cover. So, the length from the basis position (the leading edge of the medium) to "a creasing position 1" and "a creasing position 2" relates to the length of the medium of the case binding cover, the thickness of the spine cover, and the offset, as shown in FIG. 14C. Note, the thickness of the spine cover is dependent upon the media type and number of sheets used for the inner sheets of the case binding, so it differs according to case binding to be generated.

The above relationship is represented in following equations.

$$\text{Creasing position 1} = (\text{Length of case binding cover}/2) - (\text{Thickness of spine cover}/2) - \text{Offset value}$$

$$\text{Creasing position 2} = (\text{Length of case binding cover}/2) - (\text{Thickness of spine cover}/2) + \text{Offset value}$$

[First Embodiment]

Next, explanation will be given for the first embodiment. In the first embodiment, explanation will be given for a case where a crease for folding is performed on a cover of a case binding in a case where the image processing apparatus 102 makes a print request for a case binding job to the image forming apparatus 101. Explanation will be given for a presupposition of the first embodiment. First, the settings explained in FIG. 13 are applied to the image forming apparatus 101, and "perform" is set for the crease for folding, and "15.0 mm" is set for the offset position from the edge of the spine cover.

Next, it is assumed that the settings explained with reference to FIG. 12A and FIG. 12B are applied to the image processing apparatus 102, and the image processing apparatus 102 has transmitted a case binding print initiation request and job setting information to the image forming apparatus 101.

Hereinafter, explanation will be given for the first embodiment with reference to a flowchart in FIG. 15.

Figure 15:
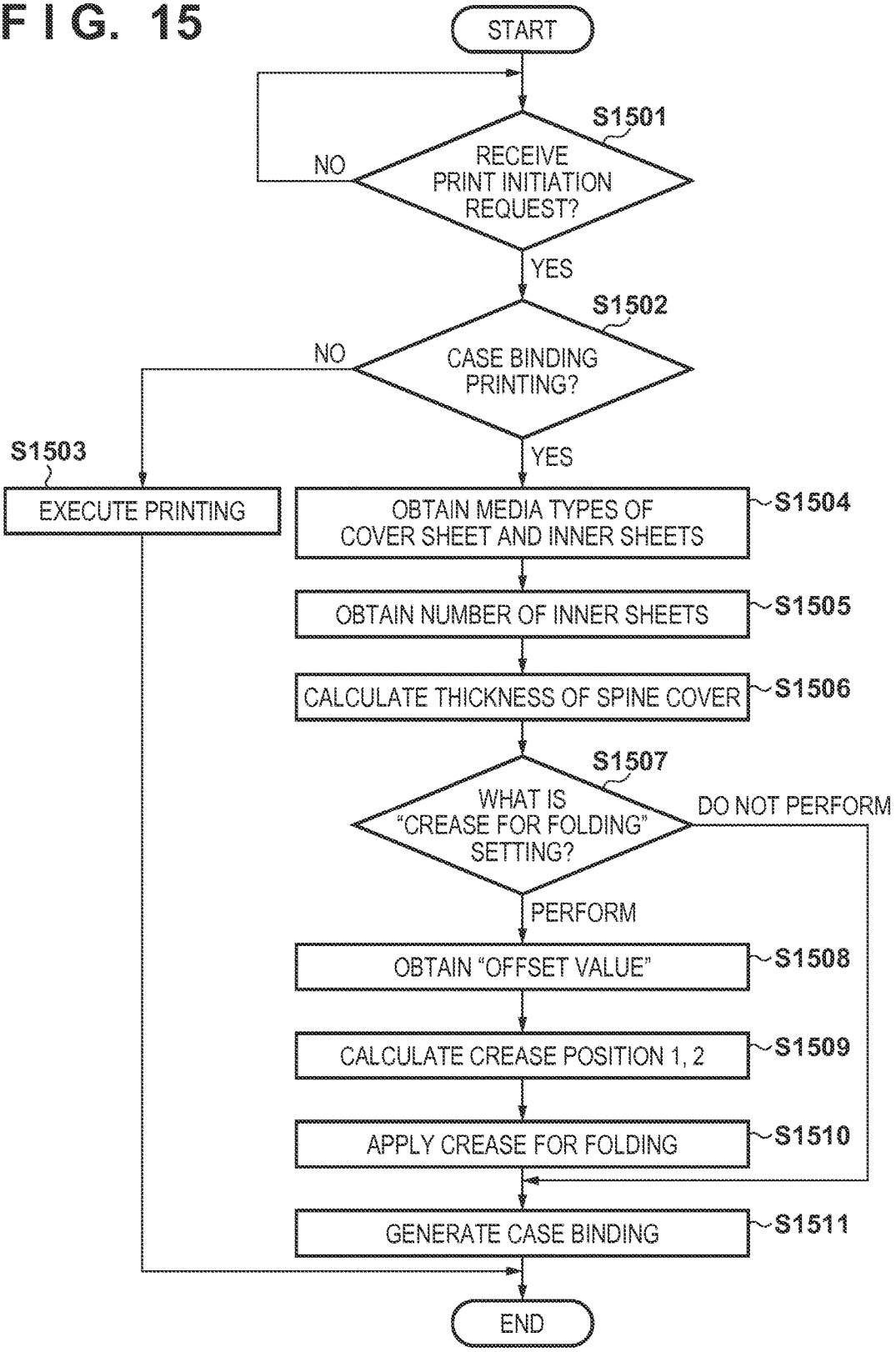
FIG. 15 is a flowchart for describing creasing processing in the image forming apparatus.

FIG. 15 is a flowchart for describing creasing processing in the image forming apparatus 101 according to the first embodiment. A program for executing this processing is stored in the ROM 803, and executed under the control of the CPU 802.

In step S1501, the CPU 802 determines whether or not the print initiation request is received from the job control unit 1107 of the image processing apparatus 102. Here, in a case where it is determined that the print initiation request is received, the processing proceeds to step S1502, and the CPU 802 analyzes job setting information and determines whether or not generation of a case binding is required. Here, in a case where it is determined that the generation of a case binding is not required, the processing proceeds to step S1503, and the CPU 802 performs processing for printing according to the job setting information and terminates the processing.

On the other hand, in a case where the generation of the case binding is required in step S1502, the processing proceeds to step S1504, and the CPU 802 acquires a media type of the case binding cover and a media type of the case binding inner sheets from the job setting information. In the example of FIG. 12A, the media types set in the media type 1202 and the media type 1205 are acquired. Next, the processing proceeds to step S1505, the CPU 802 waits until all of the image data for printing RIPed in the image processing apparatus 102 is received, and counts up the inner sheet image data items. Normally, double-sided printing is performed for case binding inner sheets, so the number of sheets is half the number of the image data items for the inner sheets. Note, the arrangement for determining the number of sheets for the inner sheets may be performed by receiving the number of mediums used for the inner sheets from the image processing apparatus 102, and is not limited to that of the first embodiment; any kind of processing which has an arrangement that can determine the number of sheets for the inner sheets may be used.

Next the processing proceeds to step S1506, and the CPU 802 calculates the thickness of the spine cover in accordance with the following equation.

Thickness of spine cover=(Thickness of medium of case binding cover)+(Thickness of medium of case binding inner sheet*number of inner sheets)

Note, the thickness of each medium is saved in the HDD 815 of the image forming apparatus 101, and the CPU 802 performs the above described calculation by reading out the stored information of the thickness for each medium.

Note, the calculation equation of the thickness of the spine cover is not limited to that of the first embodiment, and may be an equation considering a mixture of mediums for the inner sheets. Next the processing proceeds to step S1507, and the CPU 802 reads in the setting for "crease for folding" of the screen of FIG. 13 from the HDD 815 of the image forming apparatus 101. Here, in a case where the setting for "crease for folding" is "do not perform", the processing proceeds to step S1511, the case binding is generated, and the processing completes.

In a case where the setting for "crease for folding" is "perform" in step S1507, the processing proceeds to step S1508. In step S1508, the CPU 802 reads in the setting for "offset position from edge of spine cover" set in the screen of FIG. 13 from the HDD 815 of the image forming apparatus 101. In the example of FIG. 13, the length is set to 15.0 mm. Next the processing proceeds to step S1509, and the CPU 802 calculates the creasing position 1 and the creasing position 2 corresponding to the case binding cover explained in FIG. 14A-FIG. 14C. Note, the calculation equation is the same as the equation previously described with reference to FIG. 14A-FIG. 14C. Next the processing proceeds to step S1510, and the CPU 802 makes an instruction for crease (creasing) processing on the case binding cover to the CPU circuit unit 901 of the creaser apparatus 204 via the CPU circuit unit 801.

Note, here, as explained with reference to FIG. 5, the information of creasing position from the basis position (the leading edge of the medium) is necessary for the creasing processing. So, the CPU 802 controls the CPU circuit unit 901 of the creaser control unit 811 via the CPU circuit unit 801 so that the crease is performed on the case binding cover at the creasing position 1 and the creasing position 2 calculated in step S1509. Then the processing proceeds to step S1511, and the CPU 802 controls the case binding control unit 812 using the CPU circuit unit 801 of the image forming apparatus main body 203 in order to perform case binding formation processing. Then, after the case binding formation processing completes, the processing completes.

As explained above, according to the first embodiment, the crease for folding can be applied to the medium which is used for the case binding cover. So, when the case binding apparatus 205 completes the case binding processing in step S1511, a case binding to which a crease for folding is applied is formed. In the first embodiment, the case binding is formed in a state in which the crease for folding is applied at the position 15.0 mm from the edge of the spine cover in the medium used for the cover.

By the first embodiment, by an operator simply designating the crease position of the cover of the case bound book using a length from the edge of the spine cover, the creasing position corresponding to the thickness of the spine cover can be determined automatically and the creasing processing can be applied. With this, there is the effect that the operator is able to easily obtain the intended bookbinding product by designating the position of the folding portion.

[Second Embodiment]

Next, explanation will be given for a second embodiment. In the second embodiment, explanation will be given for a case where a creasing for folding is performed on a cover of a saddle stitch binding in a case where the image processing apparatus 102 makes a print request for a saddle stitch binding job to the image forming apparatus 101. Note, the configuration of the image forming apparatus 101, the image processing apparatus 102, and the sheet processing system according to the second embodiment is the same as the previously described first embodiment, so explanation of these will be omitted.

Figure 16A:
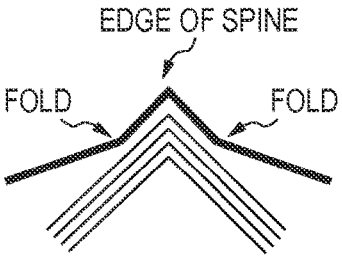
FIG. 16A and FIG. 16B are views for explaining a positional relationship between the edge of the spine and the fold regarding a saddle stitch binding.
Figure 16B:
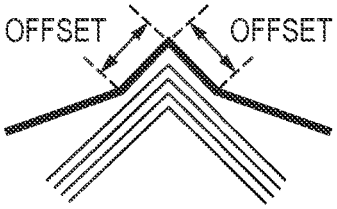

FIG. 16A and FIG. 16B are views for explaining a positional relationship between an edge of a spine and a fold relating to the saddle stitch binding according to the second embodiment.

As shown in FIG. 16A, a fold is present in both a front cover and a back cover of the saddle stitch binding. Also, the length between the edge of the spine and the fold is referred to as an "offset".

Figure 16C:
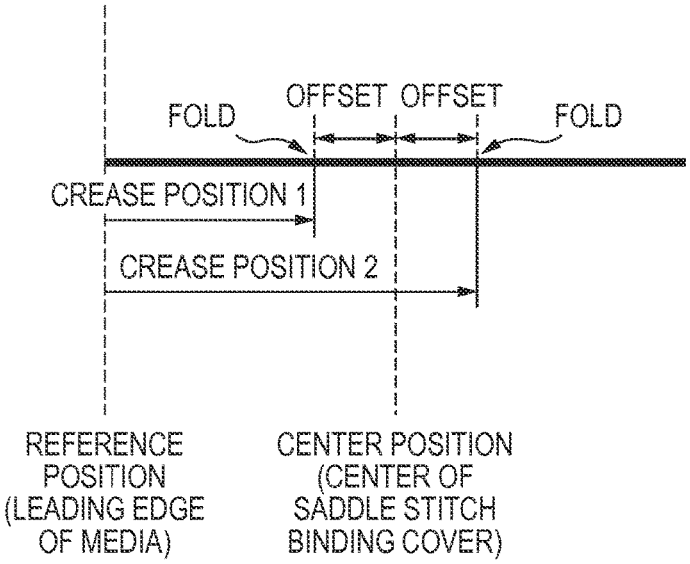
FIG. 16C is a view for showing a relationship between the edge of the spine, the position of the fold, and the creasing position.

FIG. 16C is a view for explaining where the position of the fold is located with respect to a basis position (a leading edge of a medium) in a cover of the saddle stitch binding.

As explained with reference to FIG. 7, the saddle stitching processing is applied to the center of a medium which is saddle stitch bound. So, the length from the basis position (the leading edge of the medium) to "the creasing position 1" and "the creasing position 2" is related to the length of the medium of the case binding cover and the offset as shown in FIG. 16C.

The above relationship is represented in following equations.

Creasing position 1=(Length of saddle stitch binding cover/2)−offset value

Creasing position 2=(Length of saddle stitch binding cover/2)+offset value

Figure 17:
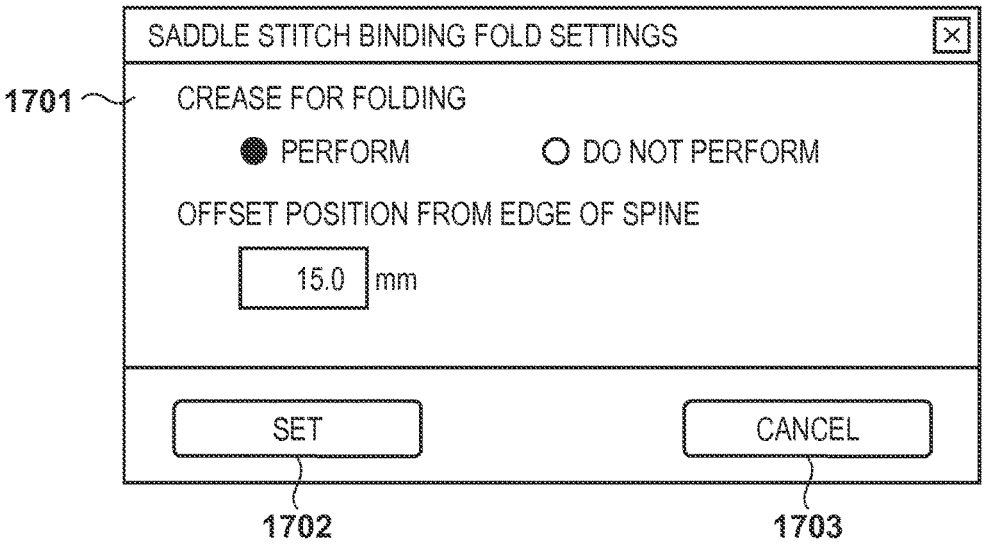
FIG. 17 is a view for illustrating an example of a saddle stitch binding fold setting screen displayed on the operation panel of the image forming apparatus.

FIG. 17 is a view for showing an example of a saddle stitch binding fold setting screen, which is substantially the same as FIG. 13. An offset value in the second embodiment is set with "offset position from edge of back" in a setting item 1701. The setting item 1701 "crease for folding", a determination button 1702, and a cancel button 1703 are the same as the setting item 1301, the determination button 1302, and the cancel button 1303 in FIG. 13, so explanation of these will be omitted.

Figure 18A:
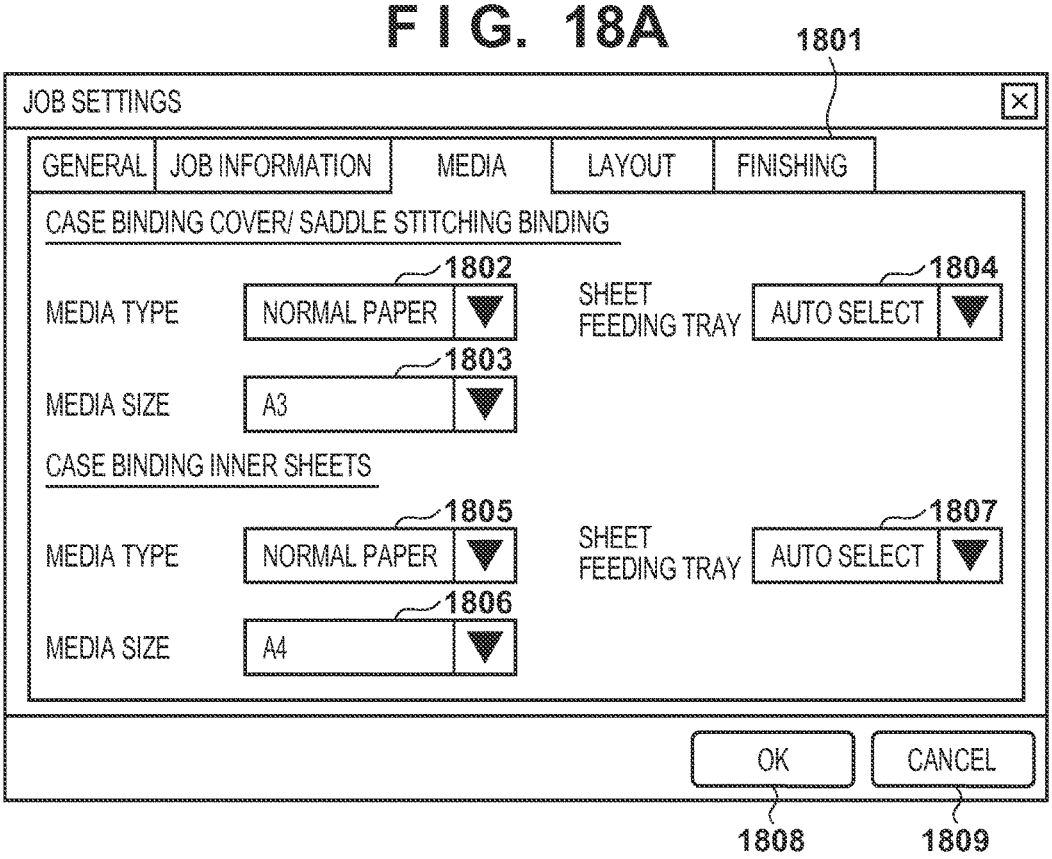
FIG. 18A and FIG. 18B are views for illustrating examples of job setting screens displayed on the display unit of the image processing apparatus.
Figure 18B:
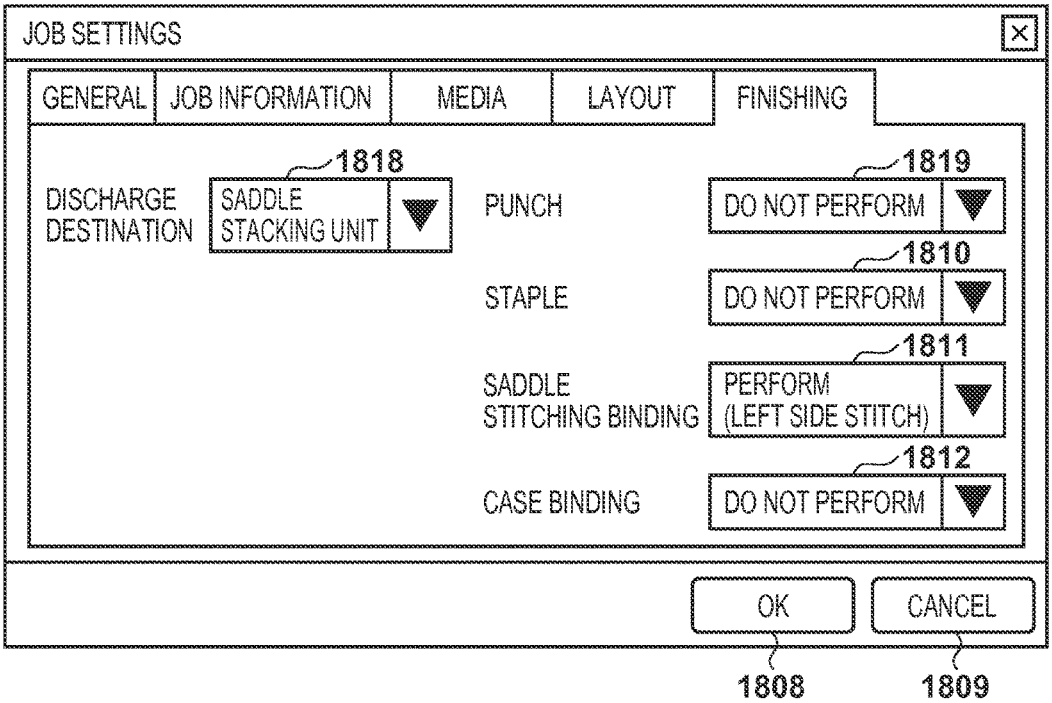

FIG. 18A and FIG. 18B are views for showing examples of job setting screens displayed on the display unit of the image processing apparatus according to the second embodiment, which are mostly the same as those of FIG. 12A and FIG. 12B in the previously described first embodiment; the following three settings are different.

Specifically, a paper discharge destination 1819 in FIG. 18B is set to "saddle stacking unit", and a saddle stitch binding 1811 is set to "perform (left stitch)", and a case binding 1812 is set to "do not perform". Remaining items 1801-1807, 1809, 1810 and 1819 are the same as 1201-1207, 1209, 1210 and 1219 in FIG. 12A and FIG. 12B, so explanation of these will be omitted.

Explanation will be given for a presupposition of the second embodiment. First, the settings shown in FIG. 17 are applied to the image forming apparatus 101, and "perform" is set for the crease for folding, and "15.0 mm" is set for the offset position from the edge of the spine.

It is assumed that the state is such that the settings as shown in FIG. 18A and FIG. 18B are applied to the image processing apparatus 102, that the saddle stitch binding print is already set, and that the image processing apparatus 102 has transmitted a saddle stitch binding print initiation request and job setting information to the image forming apparatus 101. Hereinafter, explanation will be given for the second embodiment with reference to a flowchart in FIG. 19.

Figure 19:
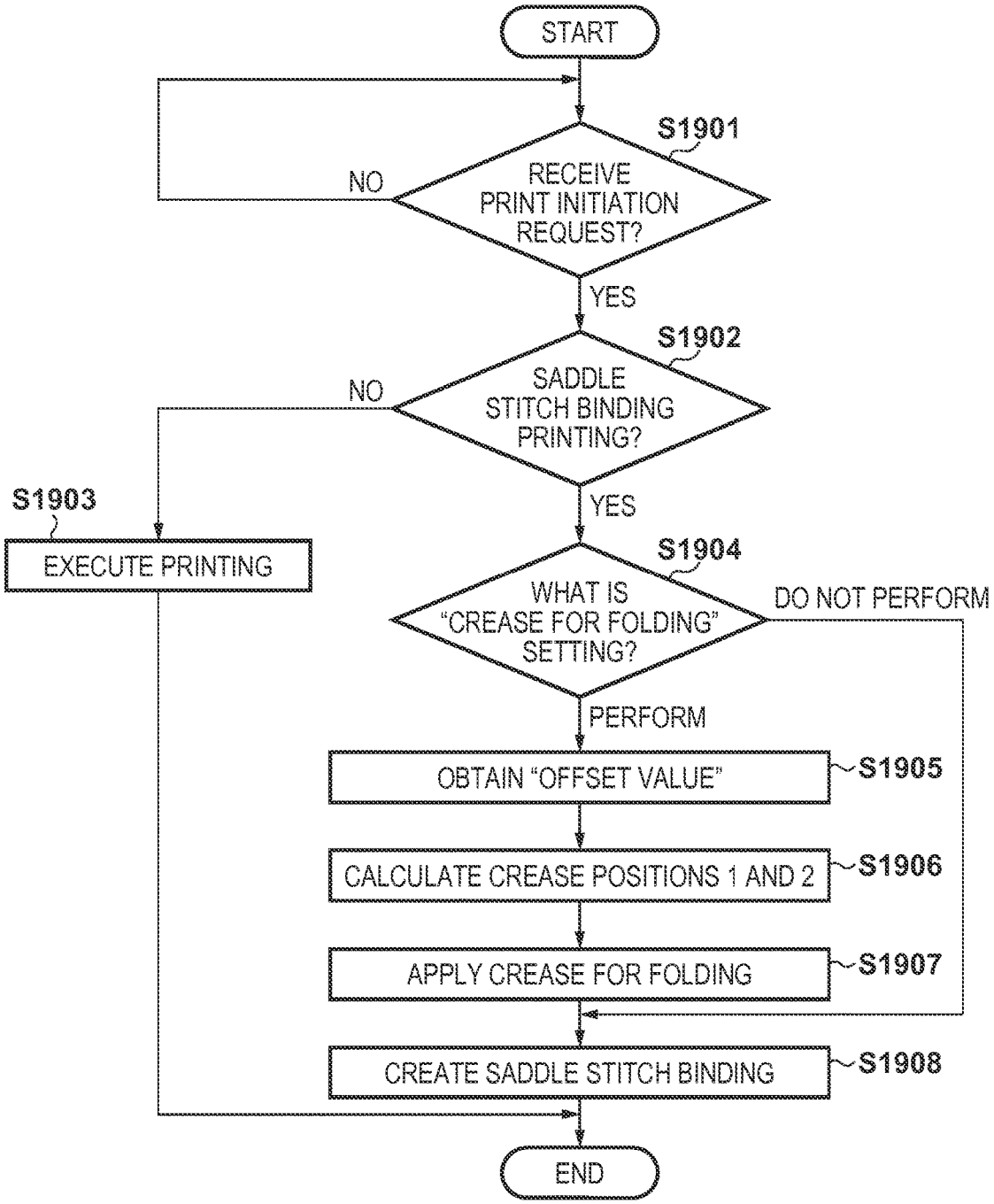
FIG. 19 is a flowchart for describing creasing processing when executing the saddle stitch binding on the image forming apparatus.

FIG. 19 is a flowchart for describing the creasing processing upon executing saddle stitch binding in the image forming apparatus 101 according to the second embodiment. A program for executing this processing is stored in the ROM 803, and executed under the control of the CPU 802.

First, the CPU 802 determines whether or not a print initiation request is received from the job control unit 1107 of the image processing apparatus 102 in step S1901, and in a case where the print initiation request is received, the processing proceeds to step S1902. In step S1902, the CPU 802 analyzes job setting information, and determines whether or not the generation of the saddle stitch binding is required. Here in a case where the generation of the saddle stitch binding is not required, the processing proceeds to step S1903 and processing for printing is executed, and the processing completes.

In a case where the generation of the saddle stitch binding is required in step S1902, the processing proceeds to step S1904, the CPU 802 reads in the setting for "crease for folding" set in the setting screen of FIG. 17 from the HDD 815 of the image forming apparatus 101. Here, in a case where the setting for "crease for folding" is "do not perform", the processing proceeds to step S1908, but in a case where the setting for "the creases for folding" is "perform", the processing proceeds to step S1905. In step S1905, the CPU 802 reads in the setting for "offset position from edge of spine cover" set in the screen of FIG. 17 from the HDD 815 of the image forming apparatus 101. In the example of FIG. 17, the length is set to 15.0 mm. Next, the processing proceeds to step S1906, and the CPU 802 calculates the creasing position 1 and the creasing position 2 in the saddle stitch binding cover explained with reference to FIG. 16C. Note, the calculation equation is in accordance with the explanation for the previously described FIG. 16A-FIG. 16C. Next, the processing proceeds to step S1907, the CPU 802 makes an instruction for the crease (creasing) processing on the saddle stitch binding cover to the CPU circuit unit 901 of the creaser apparatus 204 via the CPU circuit unit 801 of the image forming apparatus main body 203.

Here, as explained with reference to FIG. 5, the information of creasing position from the basis position (the leading edge of the medium) is necessary for the creasing processing. So the CPU 802 controls to perform creasing on the saddle stitch binding cover at the creasing position 1 and the creasing position 2 calculated in step S1906. Then the processing proceeds to step S1908, the CPU 802 executes saddle stitch binding formation processing by controlling the finisher control unit 813 using the CPU circuit unit 801 of the image forming apparatus main body 203 in order to perform the saddle stitch binding formation processing.

In this way, the creases for folding are applied to the medium used for the saddle stitch binding cover. With this, when the finisher apparatus 206 completes the saddle stitch binding processing in step S1908, a saddle stitch binding to which a crease for folding is applied is formed. Note, in the second embodiment, the saddle stitch binding is formed with the creases for folding being applied at positions 15.0 mm away from the edge of the spine.

By the second embodiment, by an operator simply designating the crease position of the cover of the saddle stitch bound book using a length from the edge of the spine cover, the creasing position corresponding to the thickness of the spine cover can be determined automatically and the creasing processing can be applied. With this, there is the effect that the operator is able to easily obtain the intended bookbinding product by designating the position of the folding portion.

[Third Embodiment]

Next, explanation will be given for a third embodiment. In the third embodiment, explanation will be given for a case in which creasing for folding is performed only on a front cover of a case binding cover with reference to a case binding stitching setting when the image processing apparatus 102 makes a case binding job print request to the image forming apparatus 101. Note, configurations of the image forming apparatus 101, the image processing apparatus 102, and the sheet processing system according to the third embodiment are the same as those of the previously described first embodiment, so explanation of these will be omitted.

Figure 20A:
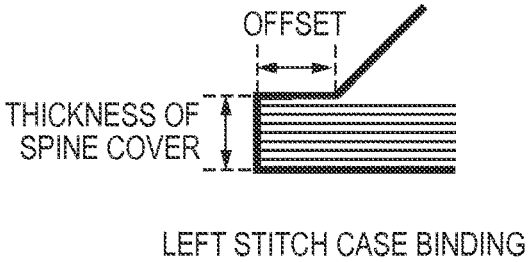
FIG. 20A is a view for explaining a left stitch case binding.
Figure 20B:
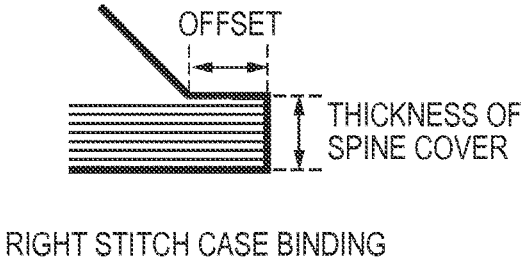
FIG. 20B is a view for explaining a right stitch case binding.

FIG. 20A and FIG. 20B are views for explaining a left stitch case binding and a right stitch case binding formed in the third embodiment. In the third embodiment, case bindings shown in FIG. 20A and FIG. 20B are formed because a crease for folding is applied to only the side of the front cover.

Figure 20C:
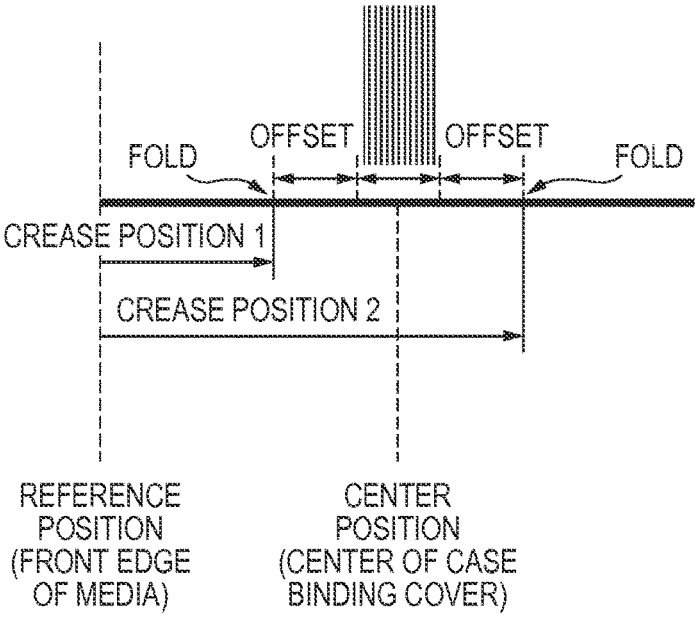
FIG. 20C is a view for explaining a creasing position.

FIG. 20C is a view for showing the relationship between a case binding formation process, and the creasing position 1 and the creasing position 2 in the case binding apparatus 205. As can be seen from the relationship between FIG. 20A, FIG. 20B, and FIG. 20C, the creasing position of the left stitch case binding corresponds to the creasing position 1, and the creasing position of the right stitch case binding corresponds to the creasing position 2.

Below, with reference to the flowchart in FIG. 15 explained in the previously described first embodiment, explanation will be given for processing, according to the third embodiment, to apply the crease for folding to only the front cover of the case binding cover.

The processing of step S1501-step S1509 is already explained, so explanation of these will be omitted. In step S1510, the CPU 802 refers to case binding setting 1212 from job setting information. Here in a case where the case binding setting 1212 is "perform (left stitch)", the CPU 802 only performs the crease (creasing) processing on the creasing position 1 in the case binding cover. Conversely, in a case where the case binding setting 1212 is "perform (right stitch)", the CPU 802 only performs the crease (creasing) processing at the creasing position 2 in the case binding cover. When this processing completes, the processing proceeds to step S1511. Note, step S1511 is already explained, so the explanation will be omitted.

From above processing, a case binding to which creasing for folding is only performed on the front cover of the case binding cover can be formed.

Note, the third embodiment is supplemented below. In the third embodiment, the top direction of the image is assumed to be towards the far side of the case binding apparatus 205. In a case where the top direction of the image is towards the close side of the case binding apparatus 205, the CPU 802 may perform the creasing processing switching the creasing position 1 and the creasing position 2 in step S1510.

As explained above, by the third embodiment, by an operator simply designating the crease position of the cover of the right stitched or left stitched case bound book using a length from the edge of the spine cover, the creasing position corresponding to the thickness of the spine cover can be determined automatically and the creasing processing can be applied. With this, there is the effect that the operator is able to easily obtain the intended bookbinding product by designating the position of the folding portion.

[Fourth Embodiment]

Next, explanation will be given for a fourth embodiment. In the fourth embodiment, explanation will be given for a case in which creasing for folding is performed only on a front cover of a saddle stitch binding cover with reference to a saddle stitch binding stitching setting when the image processing apparatus 102 makes a saddle stitch binding job print request to the image forming apparatus 101. Note, configurations of the image forming apparatus 101, the image processing apparatus 102, and the sheet processing system according to the fourth embodiment are the same as those of the previously described first embodiment, so explanation of these will be omitted.

Figure 21A:
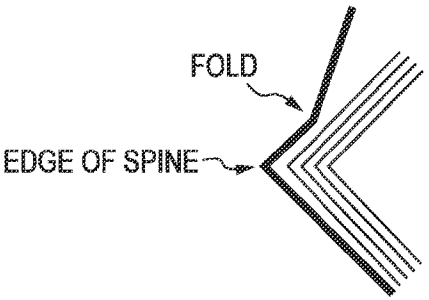
FIG. 21A and FIG. 21B are views for explaining a left stitch saddle stitch binding and a right stitch saddle stitch binding.
Figure 21B:
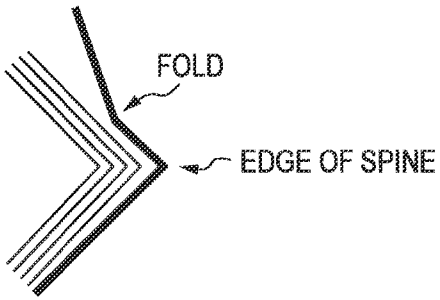

FIG. 21A and FIG. 21B are views for explaining a left stitch saddle stitch binding and a right stitch saddle stitch binding formed in the fourth embodiment. In the third embodiment, case bindings shown in FIG. 21A and FIG. 21B are formed because a crease for folding is applied to only the side of the front cover.

Figure 21C:
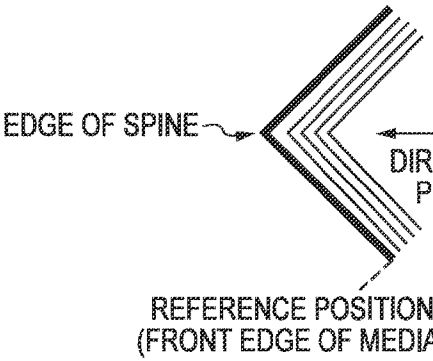
FIG. 21C is a view for showing a saddle stitch binding formation process in the finisher apparatus.

FIG. 21C is a view for showing a saddle stitch binding formation process in the finisher apparatus 206. As shown in FIG. 21C, a downward direction in the figure is a basis position of a medium, and in a case where a saddle stitch binding is formed, the folding plate 716 applies pressure on the center of the saddle stitch binding, from right to left in the figure.

Figure 21D:
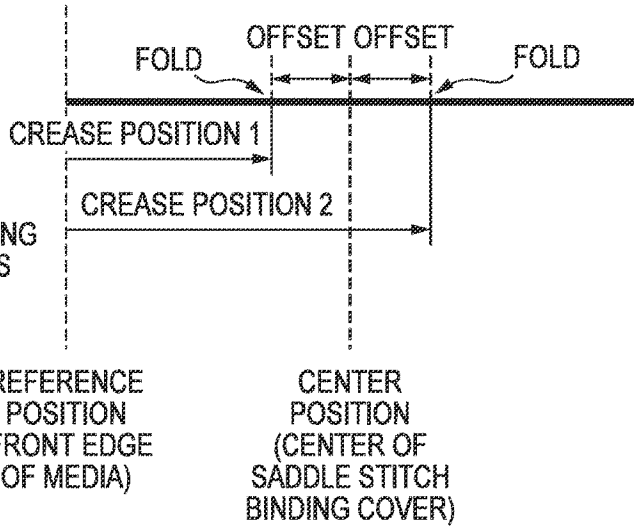
FIG. 21D is a view for explaining a creasing position corresponding to a saddle stitch binding cover.

FIG. 21D is a view for explaining the creasing position 1 and the creasing position 2 in the saddle stitch binding cover. As can be seen from the relationship between FIG. 21A, FIG. 21B, FIG. 21C, and FIG. 21D, the creasing position of the left stitch saddle stitch binding corresponds to the creasing position 1, and the creasing position of the right stitch saddle stitch binding corresponds to the creasing position 2.

Below, with reference to the flowchart in previously described FIG. 19, explanation will be given for processing for applying the crease for folding toward only the front cover of the saddle stitch binding cover in the fourth embodiment.

The processing of step S1901-step S1906 is already explained, so explanation of these will be omitted. In step S1907, the CPU 802 refers to the saddle stitch binding 1811 setting in FIG. 18A and FIG. 18B in the job setting information. Here in a case where the saddle stitch binding 1811 is "perform (left stitch)", the CPU 802 only performs the crease (creasing) processing at the creasing position 2 in the saddle stitch binding cover. Conversely in a case where the saddle stitch binding 1811 is "perform (right stitch)", the CPU 802 only performs the crease (creasing) processing at the creasing position 1 in the saddle stitch binding cover. When this processing completes, the processing proceeds to step S1908 and the saddle stitch binding processing is executed.

From above processing, a saddle stitch binding to which creasing for folding is only performed on the front cover of the saddle stitch binding cover can be formed.

Note, the fourth embodiment is supplemented below. In the fourth embodiment, the top direction of the image is assumed to be the far side of the finisher apparatus 206. In a case where the top direction of the image is the close side of the finisher apparatus 206, the CPU 802 may perform the creasing processing switching the creasing position 1 and the creasing position 2 in step S1907.

By the fourth embodiment, by an operator simply designating the crease position of the cover of the saddle stitch bound book using a length from the edge of the spine cover, the creasing position corresponding to the thickness of the spine cover can be determined automatically and the creasing processing can be applied. With this, there is the effect that the operator is able to easily obtain the intended bookbinding product by designating the position of the folding portion.

[Fifth Embodiment]

Next, explanation will be given for a fifth embodiment. In the fifth embodiment, explanation will be given for an approach for displaying a warning message in a case in which a picture in the first page of the body is hidden in a case where the case binding front cover is folded at the creasing position for folding. Note, configurations of the image forming apparatus 101, the image processing apparatus 102, and the sheet processing system according to the fifth embodiment are the same as those of the previously described first embodiment, so explanation of these will be omitted.

Figure 22:
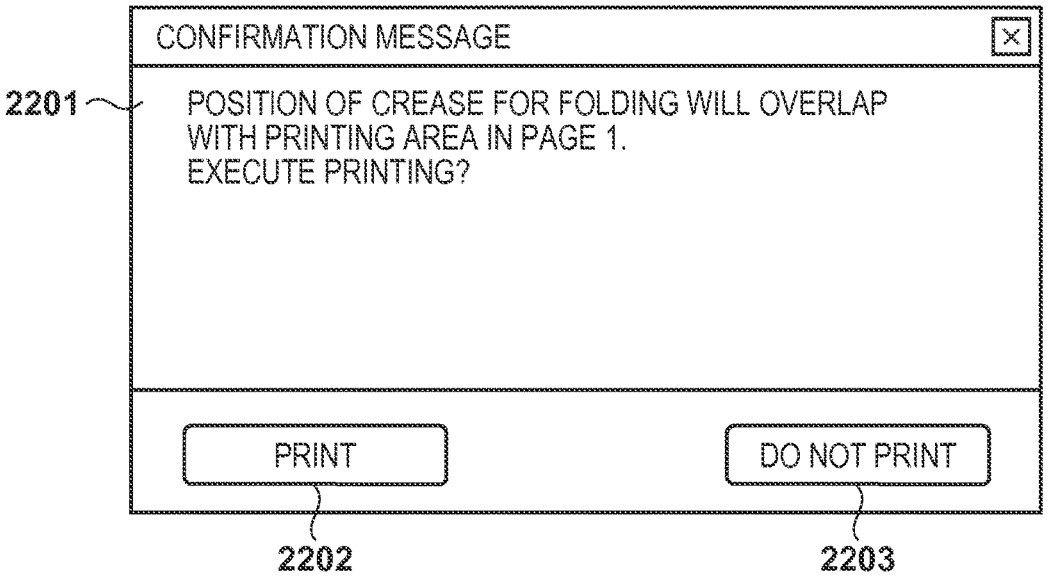
FIG. 22 is a view for illustrating an example of a confirmation message screen displayed on the display unit of the image processing apparatus.

FIG. 22 is a view for showing an example of a confirmation message screen displayed on the display unit 1002 of the image processing apparatus 102 according to the fifth embodiment. Note, the CPU 1001 of the image processing apparatus 102 performs display processing for the confirmation message in FIG. 22.

A confirmation message body 2201 displays the content to be confirmed by an operator. In the fifth embodiment, a confirmation of whether or not to continue with the printing is made because the position of the crease for folding is overlapping with a printed portion on the first page of the body. A print button 2202 is a button to be pressed by the operator in a case where the printing is to be executed. A do not print button 2203 is a button to be pressed by the operator in a case the printing is not to be executed.

Next, with reference to the flowchart in FIG. 23, explanation will be given for the processing for displaying the warning message in a case where a picture in a first page of the body is hidden in a case where the case binding front cover is folded at the creasing position for folding. Note, the settings in FIG. 12A and FIG. 12B are assumed to be performed for the print settings similarly to the case of the first embodiment.

Figure 23:
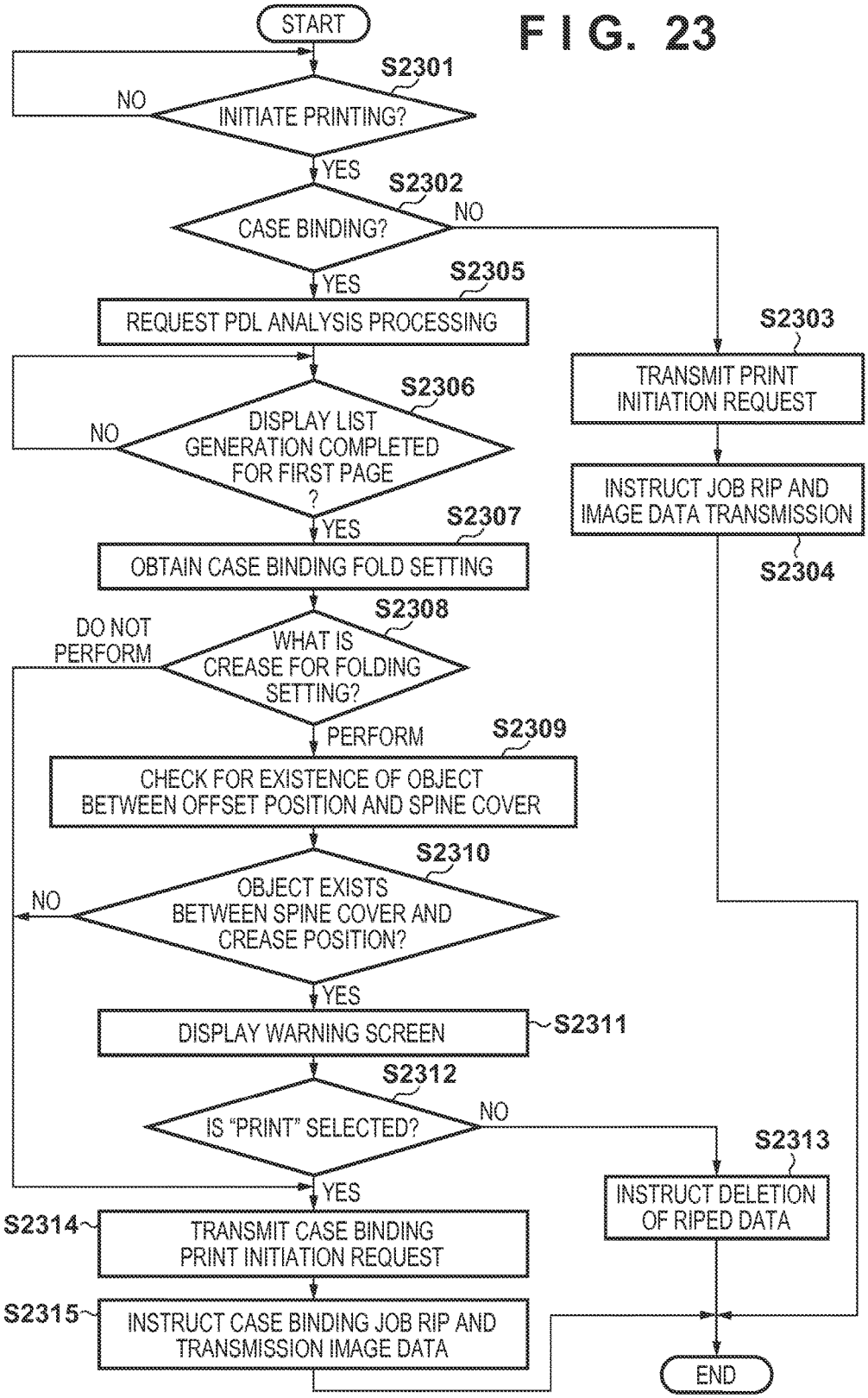
FIG. 23 is a flowchart for describing a procedure for warning processing for when a picture of a first page of a body is hidden which is performed by the image processing apparatus.

FIG. 23 is a flowchart for describing a warning processing procedure performed by the image processing apparatus 102 according to the fifth embodiment in a case where a picture in a first page of the body is hidden. A program for executing the processing is stored in the ROM 1007, and the processing is realized by the program being executed under the control of the CPU 1001.

In step S2301, the CPU 1001 determines whether or not a print initiation is instructed. Specifically, it is determined whether or not the OK button 1208 in FIG. 12A and FIG. 12B is pressed, and in a case where the button is pressed, the processing leaves loop of step S2301, the processing proceeds to step S2302, and the print settings set in the screen of FIG. 12A and FIG. 12B are transmitted to the image forming apparatus 101 as job setting information. In step S2302, the CPU 1001 analyzes the job setting information and determines whether or not it is the print initiation of a case binding; if that is the case, the processing proceeds to step S2305, and when that is not the case the processing proceeds to step S2303, and normal print processing is executed. Note, it is determined to be a print initiation of a case binding in a case where the case binding 1212 in FIG. 12B is either "perform (left stitch)" or "perform (right stitch)". In step S2303, the CPU 1001 transmits a print initiation request and the received job setting information to the device control unit 1102 of the image forming apparatus 101, and the processing proceeds to step S2304. In step S2304, the CPU 1001 instructs print job RIP processing and transmits RIPed image data to the image forming apparatus 101, the processing completes.

On the other hand, in a case where it is determined to be a case binding in step S2302, the processing proceeds to step S2305, the CPU 1001 executes RIP processing on the first page of the body, and the processing transitions to step S2306. Here, when the RIP processing unit 1108 receives a RIP processing request for the first page of the body, the RIP processing unit 1108 generates a display list for the first page of the body, and transmits a display list generation completion notification at a stage when the generation of the display list is completed. Step S2306 is a loop for the CPU 1001 to detect a display list generation completion notification for the first page of the body. Here in a case where the CPU 1001 receives the display list generation completion notification, the processing proceeds to step S2307, the CPU 1001 transmits a case binding fold setting acquisition request to the image forming apparatus 101. The CPU 802 of the image forming apparatus 101, having received case binding fold setting acquisition request, acquires case binding fold settings saved in the HDD 815, and returns the setting information to the image processing apparatus 102. Like this, in a case the case binding fold settings are received, the processing transitions to step S2308.

In step S2308, the CPU 1001 analyzes the acquired information of the case binding fold settings and determines whether the setting for "crease for folding" is "perform" or "do not perform". Here in a case of "do not perform", the processing transitions to step S2314, and in a case of "perform", the processing transitions to step S2309. In step S2309, the CPU 1001 references the display list for the first page of the body, and examines whether or not an object exists between the offset position and the edge of the sheet on the spine cover side. Next, the processing proceeds to step S2310, the CPU 1001 determines whether or not an object exists between the offset position and the edge of the sheet on the spine cover side in the first page of the body, and in a case where it is determined that an object exists, the processing proceeds to step S2311. Meanwhile, in a case where it is determined that an object does not exist between the offset position and the edge of the sheet on the spine cover side in the first page of the body, the processing proceeds to step S2314.

In step S2311, the CPU 1001 displays a confirmation message as shown in FIG. 22 for example, and the processing proceeds to step 52312. The processing proceeds to step S2312, the CPU 1001 determines whether the operator selects the print button 2202 or the do not print button 2203, and when the print button 2202 is pressed, the processing proceeds to step S2314. On the other hand, in a case where the do not print button 2203 is pressed, the processing proceeds to step S2313. In step S2313, the CPU 1001 deletes the RIPed data because the printing is not executed, and the processing completes.

Meanwhile, in step S2314, the CPU 1001 transmits a case binding print initiation request and the received case binding job setting information to the image forming apparatus 101, and the processing transitions to step S2315. In step S2315, the CPU 1001 instructs print job RIP processing and transmits RIPed image data to the image forming apparatus 101, and the processing completes.

As explained above, by the fifth embodiment, an operator can be warned in a case where a picture in the first page of the body is hidden when the case binding front cover is folded at the creasing position for folding.

[Sixth Embodiment]

Next, explanation will be given for a sixth embodiment. In the sixth embodiment, explanation will be given for an approach for displaying a warning message in a case where a picture in the first page of the body is hidden in a case where a saddle stitch binding front cover is folded at the creasing position for folding. Note, configurations of the image forming apparatus 101, the image processing apparatus 102, and the sheet processing system according to the sixth embodiment are the same as those of the previously described first embodiment, so explanation of these will be omitted. The sixth embodiment is something that replaces the case binding processing of the fifth embodiment with saddle stitch binding.

In the sixth embodiment, the settings in FIG. 18A and FIG. 18B are assumed to be performed for the print settings similarly to the second embodiment. Also, the confirmation message is, similarly to the fifth embodiment, displayed on the warning screen as shown in FIG. 22, for example.

For the processing of the image processing apparatus 102 according to the sixth embodiment, processing pertaining to case binding need only be replaced with processing pertaining to saddle stitch binding in the flowchart of FIG. 23 of the fifth embodiment.

As explained above, by virtue of the sixth embodiment, an operator can be warned in a case where a picture in the first page of the body is hidden when the saddle stitch binding front cover is folded at the creasing position for folding.

[Seventh Embodiment]

Next, explanation will be given for a seventh embodiment. In the seventh embodiment, explanation will be given for an approach for preventing a case binding crease for folding position setting from overlapping a glued portion of the case binding. Note, configurations of the image forming apparatus 101, the image processing apparatus 102, and the sheet processing system according to the seventh embodiment are the same as those of the previously described first embodiment, so explanation of these will be omitted.

Figure 24A:
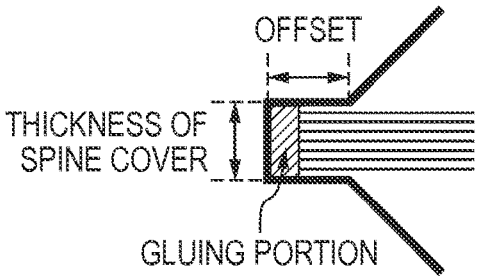
FIG. 24A is a view for illustrating an example of a glued portion of a case binding.

FIG. 24A is a view for showing a state in which a case binding is formed where a cover and an inner sheet bundle are glued at a spine cover portion. Here, the glue that is used depends on the capabilities of the case binding apparatus, but in general there are many cases in which the thickness of the gluing is around 7.0 mm.

With a crease for folding, by applying the creasing at a designated position, there is the effect of guiding the positioning of the double-page spread of the cover. In other words, the opening of the cover at the glued portion can be avoided by not applying the creases for folding to the glued portion. With this, it is possible to avoid applying a force to the glued position when opening the cover, and there is the effect that the glued cover and inner sheets being peeled off can be prevented.

Figure 24B:
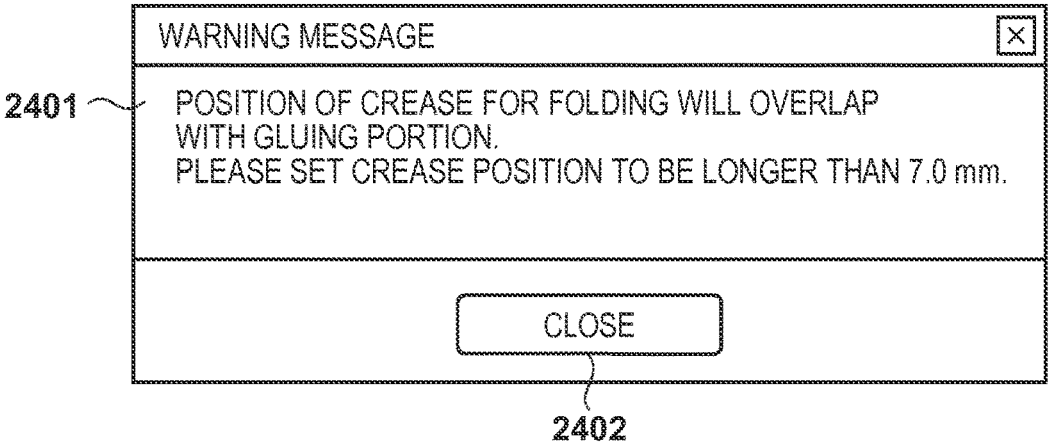
FIG. 24B is a view for illustrating an example of a warning message screen.

FIG. 24B is a view for illustrating an example of a warning message screen displayed on the operation panel 425 of the image forming apparatus 101.

This is, for example, a screen displayed in a case where, in the case binding folding settings of FIG. 13, the offset position from the edge of the spine cover is set to be less than or equal to 7.0 mm, the determination button 1302 is pressed.

A warning message body 2401 instructs so that the offset position from the edge of the spine cover be set to be longer than 7.0 mm. The close button 2402 is a button that the operator presses after confirming the warning message. When the close button 2402 is pressed, the processing returns to FIG. 13.

By adding the above described processing to the first embodiment, it is possible to prevent the setting for the position of the crease for folding in case binding from overlapping the glued portion of the case binding.

Note that there is no limitation to the example recited above, and configuration may also be taken such that, for example, in FIG. 13 a restriction is arranged to make the inputtable range for the offset position from the edge of the spine cover to start from larger than 7.0 mm.

As explained above, by virtue of the seventh embodiment, it is possible to prevent the setting for the position of the crease for folding in case binding from overlapping the glued portion off the case binding. With this, it is possible to avoid applying a force to the glued position when opening the cover, and there is the effect that the glued cover and inner sheets being peeled off can be prevented.

Explanation was given for examples of a sheet processing system having the image forming apparatus 101 and the image processing apparatus 102 as embodiments, but the present invention may be embodied in a form in which the processing of the image forming apparatus 101 and the image processing apparatus 102 is integrated.

Also, a configuration in which the processing of the UI processing unit 1101 of the image forming apparatus 101 is performed by the UI processing unit 1106 of the image processing apparatus 102, and in which saving and reading out of settings in the HDD 815 of the image forming apparatus 101 is performed via the network 103.

By virtue of the above described embodiments, an operator need only designate a relative position from the spine cover for the position of the creases for folding, and therefore it is possible to cut out the effort of the operator calculating the position, and work can be optimized.

Also, because it becomes possible to make a designation in a form of a shift to the spine cover side by x more millimeters for the actual bookbinding print material, it is possible to prevent the generation of unnecessary printed materials due to mistakes in the calculation of the position of the creasing.

[Other Embodiments]

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-046756, filed Mar. 10, 2014, which is hereby incorporated by reference wherein in its entirety.

What is claimed is:

1. A sheet processing apparatus comprising:

an image forming unit configured to form an image on a sheet;

a creasing unit configured to crease a sheet conveyed from the image forming unit;

a case binding unit configured to glue inner sheets with a cover sheet and to form a bookbinding product from the inner sheets and the cover sheet, wherein the inner sheets are conveyed from the image forming unit and are not creased by the creasing unit while being conveyed toward the case binding unit, and the cover sheet is conveyed from the image forming unit and is creased by the creasing unit while being conveyed toward the case binding unit; and a control unit configured to determine a creasing position of the cover sheet based on at least (i) a size of the cover sheet, (ii) a thickness of a spine cover of the bookbinding product, and (iii) an offset value which is a length from an edge of the spine cover, wherein the thickness of the spine cover is determined based on a type of the cover sheet, a type of the inner sheets and a number of the inner sheets, and the offset value is a value input in accordance with a user instruction, wherein the control unit is configured to control the creasing unit to crease the cover sheet at the determined creasing position.

2. The sheet processing apparatus according to claim 1, further comprising a crease setting unit configured to accept a setting of whether or not to apply crease for folding processing to the cover sheet of the bookbinding product.

3. The sheet processing apparatus according to claim 1, wherein the thickness of the spine cover is determined based on a thickness of the cover sheet.

4. The sheet processing apparatus according to claim 3, further comprising:

a setting unit configured to set a size and the type of the cover sheet, and the type of the inner sheets, wherein the types of the cover sheet and the inner sheets are media types; and a storage unit configured to store a thickness for each medium of the cover sheet and the inner sheets in accordance with the respective media type, wherein the control unit, based on the media types of the cover sheet and the inner sheets set by the setting unit and thicknesses corresponding to those media types stored in the storage unit, determines the thickness of the spine cover.

5. The sheet processing apparatus according to claim 1, wherein the creasing unit executes creasing processing only on a front cover of the cover sheet.

6. The sheet processing apparatus according to claim 1, further comprising:

a determining unit configured to determine whether or not a picture on a first page of the bookbinding product is hidden by the cover sheet when the cover sheet, which has been creased by the creasing unit, is folded at the creasing position; and a warning unit configured to issue a warning prior to execution of the creasing by the creasing unit when the determining unit determines that the picture of the first page is hidden by the cover sheet.

7. The sheet processing apparatus according to claim 1, further comprising a warning unit configured to issue a warning prior to execution of the creasing by the creasing unit when it is determined that the position of the crease overlaps a glued portion of a case binding.

8. An image forming apparatus comprising:

an image forming unit configured to form an image on a sheet;

a creasing control unit configured to control a creasing unit to crease a sheet conveyed from the image forming unit; and a case binding control unit configured to control a case binding unit to glue inner sheets with a cover sheet and to form a bookbinding product from the inner sheets and the cover sheet, wherein the inner sheets are conveyed from the image forming unit and are not creased by the creasing unit while being conveyed toward the case binding unit, and the cover sheet is conveyed from the image forming unit and is creased by the creasing unit while being conveyed toward the case binding unit, wherein the creasing control unit is configured to determine a creasing position of the cover sheet based on at least (i) a size of the cover sheet, (ii) a thickness of a spine cover of the bookbinding product, and (iii) an offset value which is a length from an edge of the spine cover, wherein the thickness of the spine cover is determined based on a type of the cover sheet, a type of the inner sheets and a number of the inner sheets, and the offset value is a value input in accordance with a user instruction, and wherein the creasing control unit is configured to control the creasing unit to crease the cover sheet at the determined creasing position.

9. An image forming apparatus comprising:

an image forming unit configured to form an image on a sheet;

a creasing control unit configured to control a creasing unit to crease a sheet conveyed from the image forming unit; and a case binding control unit configured to control a case binding unit to glue inner sheets with a cover sheet and to form a bookbinding product from the inner sheets and the cover sheet, wherein the inner sheets are conveyed from the image forming unit and are not creased by the creasing unit while being conveyed toward the case binding unit, and the cover sheet is conveyed from the image forming unit and is creased by the creasing unit while being conveyed toward the case binding unit, wherein the creasing control unit is configured to determine a creasing position of the cover sheet based on at least (i) a thickness of a spine cover of a bookbinding product which is formed from the cover sheet and the inner sheets and (ii) an offset value which is a length from an edge of the spine cover, wherein the thickness of the spine cover is determined based on a type of the cover sheet, a type of the inner sheets and a number of the inner sheets, and the offset value is a value input in accordance with a user instruction, and wherein the creasing control unit is configured to control the creasing unit to crease the cover sheet at the determined creasing position.

* * * * *